US009989044B2

(12) United States Patent
Bayyouk et al.

(10) Patent No.: US 9,989,044 B2
(45) **Date of Patent: *Jun. 5, 2018**

(54) OFFSET VALVE BORE IN A RECIPROCATING PUMP

(71) Applicant: S.P.M. FLOW CONTROL, INC., Fort Worth, TX (US)

(72) Inventors: Jacob A. Bayyouk, Richardson, TX (US); Donald Mackenzie, Glasgow (GB)

(73) Assignee: S.P.M. FLOW CONTROL, INC., Fort Worth, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/728,180

(22) Filed: Oct. 9, 2017

(65) Prior Publication Data

US 2018/0030973 A1 Feb. 1, 2018

Related U.S. Application Data

(63) Continuation of application No. 14/195,165, filed on Mar. 3, 2014, now Pat. No. 9,784,262, which is a (Continued)

(51) Int. Cl.
*F04B 27/10* (2006.01)
*F04B 39/12* (2006.01)
(Continued)

(52) U.S. Cl.
CPC ..... *F04B 39/122* (2013.01); *F04B 23/06* (2013.01); *F04B 27/00* (2013.01); *F04B 53/16* (2013.01)

(58) Field of Classification Search
CPC .. F04B 27/02; F04B 1/00; F04B 23/06; F04B 27/00; F04B 39/122; F04B 53/16;
(Continued)

(56) References Cited

U.S. PATENT DOCUMENTS 2,006,879 A 7/1935 Benedek
2,666,026 A 1/1954 Gibbs
(Continued)

FOREIGN PATENT DOCUMENTS

AR 084230 A1 5/2013
AR 084231 A1 5/2013
(Continued)

OTHER PUBLICATIONS

A. Al-Hashem et al., "Cavitation Corrosion Behavior of Some Cast Alloys in Seawater", Kuwait Institute for Scientific Research, 1996, 311-321.

(Continued)

*Primary Examiner* — Bryan Lettman
(74) *Attorney, Agent, or Firm* — Haynes and Boone LLP

(57) ABSTRACT

A fluid end (15) for a multiple reciprocating pump assembly (12) comprises at least three plunger bores (61) or (91) each for receiving a reciprocating plunger (35), each plunger bore having a plunger bore axis (65) or (95). Plunger bores being arranged across the fluid head to define a central plunger bore and lateral plunger bores located on either side of the central plunger bore. Fluid end (15) has suction valve bores (59) or (89), each suction valve bore receiving a suction valve (41) and having a suction valve bore axis (63) or (93). Discharge valve bores (57) or (87), each discharge valve bore receiving a discharge valve (43) and having a discharge valve bore axis (63) or (93). The axes of at least one of suction and discharge valve bores is inwardly offset in the fluid end from its respective plunger bore axis.

20 Claims, 12 Drawing Sheets

Related U.S. Application Data continuation of application No. 13/314,831, filed on Dec. 8, 2011, now Pat. No. 8,662,864.

(60) Provisional application No. 61/421,453, filed on Dec. 9, 2010.

(51) Int. Cl.
*F04B 53/16* (2006.01)
*F04B 27/00* (2006.01)
*F04B 23/06* (2006.01)

(58) Field of Classification Search
CPC ..... F04B 53/162; F04B 27/10; F04B 25/005; F04B 27/005; F04B 39/12; F04B 39/121; F04B 39/123; F04B 41/06
See application file for complete search history.

(56) References Cited

U.S. PATENT DOCUMENTS 2,732,810 A 1/1956 Simpson
2,776,701 A 1/1957 Denis
2,899,247 A * 8/1959 Clarkson ..... F04B 1/00 92/194
2,901,981 A * 9/1959 Wakeman ..... A01J 11/16 366/176.1
3,081,252 A 3/1963 Preiser et al.
3,159,559 A 12/1964 Eberhardt, III
3,185,103 A * 5/1965 Yohpe ..... F04B 1/00 417/454
3,470,077 A 9/1969 William
3,679,332 A * 7/1972 Yohpe ..... F04B 1/00 417/503
3,810,716 A 5/1974 Abrahams et al.
3,844,921 A 10/1974 Benedict
3,919,068 A 11/1975 Wildon
3,963,384 A 6/1976 Bastenhof
4,097,357 A 6/1978 Jacquelin
4,264,286 A * 4/1981 Reinkemeyer ..... F04B 1/00 417/539
4,339,227 A 7/1982 Furst
4,370,211 A 1/1983 Hybler
4,378,853 A 4/1983 Chia et al.
4,412,792 A 11/1983 Laborde et al.
4,520,837 A 6/1985 Cole et al.
4,861,241 A 8/1989 Gamboa et al.
4,878,815 A 11/1989 Stachowiak
5,059,101 A 10/1991 Valavaara
5,102,297 A 4/1992 Thompson
5,127,807 A 7/1992 Eslinger
5,154,589 A 10/1992 Ruhl et al.
5,171,136 A 12/1992 Pacht
5,246,355 A 9/1993 Matzner et al.
5,273,407 A * 12/1993 Jarchau ..... B01F 15/0201 138/45
D354,495 S 1/1995 Tojo
D355,199 S 2/1995 Ousey
D361,575 S 8/1995 Makino
5,584,672 A 12/1996 Simonette
5,636,975 A * 6/1997 Tiffany ..... F04B 53/007 137/454.4
5,639,227 A 6/1997 Mills
5,823,541 A 10/1998 Dietle et al.
5,839,468 A 11/1998 Allred
5,848,878 A 12/1998 Conti et al.
5,947,697 A 9/1999 Morrison
D420,683 S 2/2000 Suzuki
6,065,453 A 5/2000 Zych
6,382,940 B1 5/2002 Blume
6,386,751 B1 5/2002 Wootan et al.
6,419,459 B1 7/2002 Sibbing
D461,733 S 8/2002 Iida
D461,827 S 8/2002 Koebbe
6,544,012 B1 4/2003 Blume
6,595,278 B1 7/2003 Lam et al.
6,623,259 B1 9/2003 Blume
6,705,396 B1 3/2004 Ivannikov et al.
6,843,313 B2 1/2005 Hult
D506,210 S 6/2005 Selic et al.
6,910,871 B1 * 6/2005 Blume ..... F04B 53/007 137/512
7,036,688 B2 5/2006 Stettes et al.
7,118,114 B2 10/2006 Burdick et al.
7,186,097 B1 3/2007 Blume
7,255,163 B2 8/2007 Rivard
D552,139 S 10/2007 Cho
D556,861 S 12/2007 Yokohari
D556,862 S 12/2007 Yokohari
D557,286 S 12/2007 Pedrollo
7,335,002 B2 2/2008 Vicars
7,341,435 B2 3/2008 Vicars
7,364,412 B2 * 4/2008 Kugelev ..... F04B 53/007 417/454
7,404,704 B2 7/2008 Kugelev et al.
D583,389 S 12/2008 Bilger
D584,320 S 1/2009 Huang
7,484,452 B2 2/2009 Baxter et al.
7,513,759 B1 4/2009 Blume
D603,870 S 11/2009 Mehnert et al.
D605,665 S 12/2009 Falkenberg
D606,629 S 12/2009 Tokumoto
D623,200 S 9/2010 Fulkerson et al.
D629,423 S 12/2010 Varini
7,874,369 B2 1/2011 Parker et al.
D641,382 S 7/2011 Hawes et al.
8,016,027 B2 9/2011 Boyles
8,074,999 B2 12/2011 Burdick et al.
8,105,055 B2 1/2012 Small
D655,314 S 3/2012 Yoshimura et al.
D657,799 S 4/2012 Jung
8,147,227 B1 * 4/2012 Blume ..... F04B 53/007 137/512
D660,191 S 5/2012 Asaba
D667,532 S 9/2012 Asaba
D670,312 S 11/2012 Alexander et al.
D670,790 S 11/2012 Tokumoto
D676,111 S 2/2013 Fukano et al.
D679,290 S 4/2013 Skurdalsvold
D679,292 S 4/2013 Bayyouk et al.
D679,293 S 4/2013 Bayyouk et al.
8,465,268 B2 * 6/2013 Baxter ..... E21B 43/25 417/437
D687,125 S 7/2013 Matzner et al.
8,496,224 B1 7/2013 Gilstad et al.
D687,929 S 8/2013 Asaba
D691,180 S 10/2013 Deleon et al.
8,662,864 B2 * 3/2014 Bayyouk ..... F04B 1/0456 417/269
8,662,865 B2 3/2014 Jacob et al.
8,668,470 B2 3/2014 Bayyouk et al.
D705,817 S 5/2014 Bayyouk
D706,397 S 6/2014 Hawes et al.
D706,832 S 6/2014 Bayyouk et al.
D706,833 S 6/2014 Deleon et al.
2003/0084556 A1 5/2003 Dunlop
2003/0235508 A1 12/2003 Vicars
2004/0170507 A1 9/2004 Vicars
2004/0213677 A1 * 10/2004 Matzner ..... F04B 51/00 417/63
2004/0219042 A1 11/2004 Kugelev et al.
2004/0234404 A1 11/2004 Vicars
2004/0239115 A1 12/2004 Wilk et al.
2005/0081830 A1 4/2005 Yu et al.
2005/0247353 A1 11/2005 Kao
2006/0002806 A1 * 1/2006 Baxter ..... F04B 39/10 417/539
2006/0124176 A1 6/2006 McIntire et al.
2006/0131533 A1 6/2006 Oh et al.
2006/0159573 A1 7/2006 Inoue et al.
2006/0273277 A1 12/2006 Heller et al.
2007/0051508 A1 3/2007 Pecorari et al.

(56) References Cited

U.S. PATENT DOCUMENTS

| | | | | |
|---|---|---|---|---|
| 2007/0237651 | A1* | 10/2007 | Tojo | F04B 53/16 417/269 |
| 2008/0003122 | A1 | 1/2008 | Tian et al. | |
| 2008/0138224 | A1* | 6/2008 | Vicars | F04B 53/007 417/545 |
| 2008/0279706 | A1 | 11/2008 | Gambier et al. | |
| 2009/0123303 | A1* | 5/2009 | Ohnishi | F04B 39/14 417/270 |
| 2009/0314645 | A1 | 12/2009 | Kim | |
| 2009/0314979 | A1 | 12/2009 | McIntire | |
| 2010/0158727 | A1* | 6/2010 | Hawes | F04B 39/121 417/521 |
| 2010/0275445 | A1 | 11/2010 | Weide | |
| 2010/0322802 | A1 | 12/2010 | Kugelev | |
| 2010/0325888 | A1 | 12/2010 | Hawes | |
| 2011/0030213 | A1 | 2/2011 | Hawes et al. | |
| 2011/0079302 | A1 | 4/2011 | Hawes | |
| 2011/0126804 | A1 | 6/2011 | Lucas et al. | |
| 2011/0173814 | A1 | 7/2011 | Patel | |
| 2011/0189040 | A1 | 8/2011 | Vicars | |
| 2011/0198072 | A1 | 8/2011 | Cote et al. | |
| 2011/0308967 | A1 | 12/2011 | Byrne | |
| 2012/0063936 | A1 | 3/2012 | Baxter et al. | |
| 2012/0141308 | A1 | 6/2012 | Saini et al. | |
| 2012/0288387 | A1 | 11/2012 | Freed et al. | |
| 2013/0020521 | A1 | 1/2013 | Byrne | |
| 2013/0042752 | A1* | 2/2013 | Marshall | F04B 47/00 92/61 |
| 2013/0112074 | A1* | 5/2013 | Small | F04B 1/0404 92/161 |
| 2013/0195701 | A1 | 8/2013 | Skurdalsvold et al. | |
| 2013/0202457 | A1 | 8/2013 | Jacob et al. | |
| 2013/0202458 | A1 | 8/2013 | Joseph et al. | |

FOREIGN PATENT DOCUMENTS

| | | | |
|---|---|---|---|
| AU | 341981 | | 4/2012 |
| AU | 343913 | | 8/2012 |
| AU | 343914 | | 8/2012 |
| AU | 346409 | | 1/2013 |
| BR | 3020120007402 | | 3/2013 |
| CA | 2486223 | C | 9/2010 |
| CA | 2350047 | C | 10/2010 |
| CA | 138269 | | 7/2011 |
| CA | 2514769 | C | 9/2011 |
| CA | 2716430 | C | 5/2012 |
| CA | 144435 | | 9/2012 |
| CA | 2711206 | C | 9/2012 |
| CA | 146660 | | 10/2013 |
| CA | 148192 | | 10/2013 |
| CA | 151028 | | 10/2013 |
| CA | 149166 | | 7/2014 |
| CN | 2677588 | Y | 2/2005 |
| CN | 201096243 | Y | 8/2008 |
| CN | 201148968 | Y | 11/2008 |
| CN | 101397672 | A | 4/2009 |
| CN | ZL201030691447 | | 2/2012 |
| CN | ZL201230031196 | | 12/2012 |
| CN | ZL201230337093 | | 3/2013 |
| CN | ZL201230324855 | | 5/2013 |
| CN | ZL201230513325 | | 5/2013 |
| CN | ZL201230643096 | | 7/2013 |
| CN | 103339379 | A | 10/2013 |
| CN | 103348139 | A | 10/2013 |
| DE | 10214404 | A1 | 10/2003 |
| EC | D-001994054-0001 | | 2/2012 |
| EC | D-001335699-0001 | | 7/2012 |
| EC | D-001335699-0002 | | 7/2012 |
| EC | D-002125732-0001 | | 1/2013 |
| EP | 0580196 | A1 | 1/1994 |
| EP | 1780415 | A1 | 5/2007 |
| GB | 1449280 | A | 9/1976 |
| GB | 2419642 | B | 7/2009 |
| GB | 2416811 | B | 9/2009 |
| IN | 243221 | | 2/2012 |
| IN | 246712 | | 3/2013 |
| JP | 2000170643 | A | 6/2000 |
| MX | 38797 | | 5/2013 |
| MX | 39667 | | 9/2013 |
| MX | 41048 | | 2/2014 |
| RU | 2168064 | C2 | 5/2001 |
| RU | 87318 | | 12/2013 |
| SA | 2446 | | 9/2012 |
| SG | D2012/168 | I | 2/2012 |
| SG | D2012/874/ | | 8/2012 |
| SG | D2012/875 | G | 8/2012 |
| SG | D2012/1221/ | | 12/2012 |
| WO | WO-2004092538 | A1 | 10/2004 |
| WO | WO-2005015024 | A1 | 2/2005 |
| WO | WO-2005088125 | A1 | 9/2005 |
| WO | WO-2011018732 | A2 | 2/2011 |
| WO | WO-2011027273 | A2 | 3/2011 |
| WO | WO-2011054948 | A1 | 5/2011 |
| WO | WO-2011160069 | A1 | 12/2011 |
| WO | WO-2012078870 | A2 | 6/2012 |
| WO | WO-2012078888 | A2 | 6/2012 |
| WO | WO-2012145591 | A1 | 10/2012 |
| WO | WO-2013116535 | | 8/2013 |

OTHER PUBLICATIONS

"Canadian Exam Report dated Jan. 10, 2013, re App No. 146660".
Cole B.N., "Strategy for Cross-Bores in High Pressure Containers," Journal of Mechanical Engineering Science, 1969, vol. 11 (2), pp. 151-176.
Co-pending U.S. Appl. No. 29/420,822, filed May 14, 2012.
"Search Report, dated Jan. 18, 2005, from the UK Patent Office, regarding App No. GB0424019.8".
"Search Report, dated Oct. 31, 2005, by the UK Patent Office, regarding App No. GB0516137.7".
"Examination Report by IP India, dated Aug. 31, 2012, re App No. 246713".
"Examination Report by IP India, dated Jan. 3, 2013, re App No. 248994".
"Examination Report by IP India, dated Mar. 28, 2013, re App No. 246713".
"Examination Report by IP India, dated Sep. 14, 2012, re App No. 246712".
"Examiner Interview Summary dated Oct. 9, 2007, by the USPTO, re U.S. Appl. No. 10/913,221".
"Final Office Action dated Jul. 20, 2007, by the USPTO, re U.S. Appl. No. 10/913,221".
"Final Office Action dated Nov. 6, 2012, by the USPTO, re Design U.S. Appl. No. 29/411,974".
"International Preliminary Report on Patentability dated Dec. 19, 2012, regarding PCT/US2011/040960".
International Search Report and Written Opinion for Application No. PCT/US2011/040960 dated Nov. 1, 2011, 6 pages.
International Search Report and Written Opinion for Application No. PCT/US2012/034397 dated Jun. 29, 2012, 10 pages.
"International Search Report and Written Opinion dated Apr. 8, 2013, by the ISA/US, regarding PCT/US2013/024172".
International Search Report and Written Opinion, dated Jul. 20, 2012, by ISA/KR, regarding PCT/US2011/063946.
"International Search Report and Written Opinion, dated Jul. 20, 2012, by ISA/KR, regarding PCT/US2011/063968".
L.M. Masu., "Numerical analysis of cylinders containing circular offset cross-bores—Abstract", Mar. 1998, vol. 75, Issue 3.
Makulsawatudom P., et al., "Stress Concentration at Crossholes in Thick Cylindrical Vessels," Journal of Strain Analysis for Engineering Design, 2004, vol. 39 (5), pp. 471-481.
Masu L.M., "Cross Bore Configuration and Size Effects on the Stress Distribution in Thick-walled Cylinders," International Journal of Pressure Vessels and Piping, 1997, vol. 72 (2), pp. 171-176.
"Notice of Allowance dated Apr. 12, 2013, by the USPTO, regarding Design U.S. Appl. No. 29/420,822".
"Notice of Allowance dated Apr. 18, 2013, by the USPTO, regarding Design U.S. Appl. No. 29/399,897".

(56) References Cited

OTHER PUBLICATIONS

"Notice of Allowance dated Dec. 12, 2007, by the USPTO, regarding U.S. Appl. No. 10/913,221".
"Notice of Allowance dated Jan. 10, 2013, by the USPTO, regarding Design U.S. Appl. No. 29/411,974".
"Notice of Allowance dated Jan. 18, 2013, by the USPTO, regarding Design U.S. Appl. No. 29/419,417".
"Notice of Allowance dated Jan. 23, 2013, by the USPTO, regarding Design U.S. Appl. No. 20/419,425".
"Notice of Allowance dated Jul. 26, 2013, by the USPTO, regarding U.S. Appl. No. 29/445,736".
"Notice of Allowance dated Mar. 27, 2008, by the USPTO, regarding U.S. Appl. No. 10/835,749".
"Notice of Allowance dated Mar. 8, 2011, by the USPTO, regarding Design U.S. Appl. No. 29/363,376".
"Notice of Allowance dated May 29, 2013, by the USPTO, re U.S. Appl. No. 29/425,284".
"Office Action dated Apr. 25, 2013, by USPTO, re U.S. Appl. No. 13/162,815".
"Office Action dated Aug. 14, 2013, by the USPTO, re U.S. Appl. No. 13/314,745".
"Office Action dated Aug. 14, 2013, by the USPTO, re U.S. Appl. No. 13/849,228".
"Office Action dated Jan. 10, 2008, by the USPTO, re U.S. Appl. No. 10/835,749".
"Office Action dated Jul. 17, 2013, by the USPTO, re U.S. Appl. No. 29/420,822".
"Office Action dated Jul. 23, 2012, by the USPTO, re Design U.S. Appl. No. 29/411,974".
"Office Action dated Jun. 21, 2007, by the USPTO, re U.S. Appl. No. 10/835,749".
"Office Action dated Mar. 29, 2007, by the USPTO, re U.S. Appl. No. 10/913,221".
"Office Action dated Nov. 9, 2010, by the USPTO, re Design U.S. Appl. No. 29/363,376".
Xie; He et al., "Fatigue Prediction for Pump End of High Pressure Fracturing Pump", 2011, vol. 337, 81-86.
"Australia Examination Report, dated Jul. 22, 2013, by IP Australia, re Reg. No. 346409".
"Canadian Exam Report dated Feb. 11, 2014, by the CIPO, re App No. 149166".
"Canadian Examination Report, dated Aug. 20, 2013, by the CIPO, re App No. 149166".
"Notice of Allowance dated Dec. 19, 2013, by the USPTO, re App No. 13/849,228".
"Notice of Allowance dated Dec. 24, 2013, by the USPTO, re U.S. Appl. No. 13/314,831".
"Notice of Allowance dated Jan. 8, 2014, by the USPTO, re U.S. Appl. No. 13/314,745".
"Notice of Allowance dated Jan. 27, 2014, by the USPTO, re U.S. Appl. No. 29/424,801".
"Notice of Allowance dated Nov. 4, 2013, by the USPTO, re U.S. Appl. No. 29/467,436".
"Notice of Allowance dated Jan. 16, 2014, by the USPTO, re U.S. Appl. No. 29/467,436".
"Notice of Allowance dated Oct. 10, 2013, by the USPTO, re U.S. Appl. No. 29/461,771".
"Notice of Allowance dated Jan. 22, 2014, by the USPTO, re U.S. Appl. No. 29/461,771".
"Notice of Allowance dated Oct. 17, 2013, by the USPTO, re U.S. Appl. No. 29/420,822".
"Notice of Allowance dated Feb. 4, 2014, by the USPTO, re U.S. Appl. No. 29/420,822".
"Notice of Allowance dated Sep. 24, 2013, by the USPTO, re U.S. Appl. No. 29/425,284".
"Notice of Allowance dated Jan. 7, 2014, by the USPTO, re U.S. Appl. No. 29/425,284".
"Office Action dated Feb. 14, 2014, by the USPTO, re U.S. Appl. No. 13/451,842".
"Office Action dated Jul. 22, 2013, by the USPTO, re U.S. Appl. No. 13/314,831".
First Office Action issued by the State Intellectual Property Office of the People's Republic of China regarding Application No. 201180066904.9 dated Mar. 30, 2015, 13 pages.
First Office Action issued by the State Intellectual Property Office of the People's Republic of China regarding Application No. 201180066898.7 dated Apr. 3, 2015, 9 pages.
First Office Action issued by the Australian Government regarding Application No. 2011338305 dated Oct. 9, 2015, 3 pages.
Extended European Search Report issued by the European Patent Office regarding Application No. 11847704.1 dated Nov. 25, 2015, 7 pages.
Examination Report No. 1 issued by IP Australia regarding related Australian patent application No. 2011338323 dated Jan. 8, 2016, 3 pages.
Extended European Search Report issued by the European Patent Office regarding Application No. 11846478.3 dated Apr. 12, 2016, 7 pages.
Final Office Action issued by the State Intellectual Property Office of the People's Republic of China regarding Application No. 201180066898.7 dated Mar. 29, 2017, 9 pages.
English Description of Office Action from the Mexican Patent Office dated Aug. 15, 2017 regarding Mexican Patent Application No. MX/a/2015/016008, 5 pages.
"Office Action dated Aug. 12, 2015, by the USPTO, re U.S. Appl. No. 14/195,165".
"Office Action dated Sep. 9, 2016, by the USPTO, re U.S. Appl. No. 14/195,165".
"Final Office Action dated Mar. 21, 2016, by the USPTO, re U.S. Appl. No. 14/195,165".
"Final Office Action dated Feb. 10, 2017, by the USPTO, re U.S. Appl. No. 14/195,165".
"Notice of Allowance dated Jun. 2, 2017, by the USPTO, re U.S. Appl. No. 14/195,165".
Examination Report issued by the Canadian Intellectual Property Office regarding related Canadian Patent Application No. 2,820,648 dated Mar. 1, 2018, 4 pages.
Examination Report issued by the Canadian Intellectual Property Office regarding related Canadian Patent Application No. 2,820,595 dated Mar. 1, 2018, 6 pages.

* cited by examiner

OFFSET VALVE BORE IN A RECIPROCATING PUMP

CROSS-REFERENCE TO RELATED APPLICATIONS

This application is a continuation of U.S. application Ser. No. 14/195,165, filed Mar. 3, 2014, which is a continuation of U.S. application Ser. No. 13/314,831, filed Dec. 8, 2011, which claims priority to provisional application No. 61/421,453 filed Dec. 9, 2010.

TECHNICAL FIELD

An arrangement is disclosed whereby a valve bore is offset from a plunger bore in a fluid end of a reciprocating pump to relieve stress.

BACKGROUND OF THE DISCLOSURE

In oil field operations, reciprocating pumps are used for various purposes. Reciprocating pumps are used for operations such as cementing, acidizing, or fracturing of a subterranean well. These reciprocating pumps run for relatively short periods of time, but they operate on a frequent basis and oftentimes at extremely high pressures. A reciprocating pump is mounted to a truck or a skid for transport to various well sites and must be of appropriate size and weight for road and highway regulations.

Reciprocating pumps or positive displacement pumps for oil field operations deliver a fluid or slurry, which may carry solid particles (for example, a sand proppant), at pressures up to 20,000 psi to the wellbore. A known pump for oilfield operations includes a power end driving more than one plunger reciprocally in a corresponding fluid end or pump chamber. The fluid end may comprise three or five plunger bores arranged transversely across a fluid head, and each plunger bore may be intersected by suction and discharge valve bores. In a known reciprocating pump, the axis of each plunger bore intersects perpendicularly with a common axis of the suction and discharge valve bores.

In a mode of operating a known three plunger bore reciprocating pump at high fluid pressures (for example, around or greater than 20,000 psi), a maximum pressure and thus stress can occur within a given pump chamber as the plunger moves longitudinally in the fluid end towards top dead center (TDC), compressing the fluid therein. One of the other pump chambers will be in discharge and thus at a very low pressure, and the other pump chamber will have started to compress the fluid therein.

It has been discovered that, in a given pump chamber, the areas of highest stress occur at the intersection of each plunger bore with its suction and discharge valve bores as the plunger moves to TDC. The occurrence of high stress at these areas can shorten the life of the fluid end.

JP 2000-170643 is directed to a multiple reciprocating pump having a small size. The pump has three piston bores in which the pistons reciprocate but, so that a compact pump configuration can be provided, the axis of each suction valve bore is arranged perpendicularly to its respective discharge valve bore (that is, so that there is a laterally directed discharge from the fluid end).

JP 2000-170643 also teaches that a limit as to the volume of fluid that can be pumped by a small reciprocating pump is the size of suction and discharge valve bores. Contrary to the embodiments disclosed herein, the teaching of JP 2000-170643 is not concerned with reducing stresses arising at the intersection of piston, suction and discharge bores. Rather, JP 2000-170643 teaches moving the axes of each of the outside suction and discharge valve bores outwardly with respect to their plunger bore axis to enable the volume of each of the suction and discharge valve bores to be increased. Thus, with an increased pump speed, an increased volumetric flow can be achieved with a pump that still has a similar overall dimensional profile. In addition, JP 2000-170643 teaches that the valve bores are moved outwardly without increasing the amount of material between the suction and discharge bores. This is because the reconfiguration of the pump in JP 2000-170643 is not concerned with reducing stresses within the pump in use.

SUMMARY

In a first aspect there is disclosed a fluid end for a multiple reciprocating pump assembly. The multiple reciprocating pump assembly may, for example, comprise three or five plunger bores, and may find application in oilfield operations and/or may operate with fluids at high pressures (for example as high as 20,000 psi or greater).

When the fluid end comprises at least three plunger bores (for example, three or five plunger bores), each can receive a reciprocating plunger, and each can have a plunger bore axis. The plunger bores can be arranged across the fluid head to define a central plunger bore and lateral plunger bores located on either side of the central plunger bore (for example, one or two lateral plunger bores located on either side of the central plunger bore to define a fluid end with three or five plunger bores respectively).

At least three respective suction valve bores (for example, three or five suction valve bores) can be provided for and be in fluid communication with the plunger bores. Each suction valve bore can receive a suction valve and have a suction valve bore axis.

At least three respective discharge valve bores (for example, three or five discharge valve bores) can be provided for and be in fluid communication with the plunger bores. Each discharge valve bore can receive a discharge valve and have a discharge valve bore axis.

In accordance with the first aspect, at least one of the axes of the suction and discharge valve bores, for at least one of the lateral plunger bores, is inwardly offset in the fluid end from its respective plunger bore axis.

It has been surprisingly discovered that this inward offsetting can reduce stress that would otherwise occur at the intersection of each plunger bore with its suction or discharge valve bores as the plunger moves to TDC. The reduction of stress can increase the useful operating life of the fluid end.

In certain embodiments, at least one of the axes of at least one of the suction and discharge valve bores for each of the lateral plunger bores may be inwardly offset. For example, for the lateral plunger bores, the at least one offset axis may be inwardly offset to the same extent as the other at least one offset axis.

In certain embodiments, the axes of both the suction and discharge valve bores may be inwardly offset for at least one of the lateral plunger bores. For example, the axes of both the suction and discharge valve bores are inwardly offset to the same extent.

In certain embodiments, for each of the plunger bores, the suction valve bore may oppose the discharge valve bore. This arrangement is easier to manufacture, maintain and service than, for example, arrangements in which the axis of each suction valve bore is perpendicular to the discharge valve bore. In addition, the opposing bore arrangement may induce less stress in the fluid end in use than, for example, a perpendicular bore arrangement.

In certain embodiments for each of the plunger bores, the axes of the suction and discharge valve bores may be aligned, for even greater ease of manufacture, maintenance and service. In certain embodiments, the at least one axis may be inwardly offset in an amount ranging from about 10% to about 60% of the diameter of the plunger bore. In certain other embodiments, the offset axis may be inwardly offset in an amount ranging from about 20% to about 50%, or from about 30% to about 40%, of the diameter of the plunger bore.

In other certain embodiments, the at least one axis may be inwardly offset in an amount ranging from about 0.5 to about 2.5 inches. In certain other embodiments, the offset axis may be offset in an amount ranging from about 1.5 to 2.5 inches. These dimensions may represent an optimal range for many bore diameters of fluid end configurations employed in fracking pumps in oilfield and related applications.

Other aspects, features, and advantages will become apparent from the following detailed description when taken in conjunction with the accompanying drawings, which are a part of this disclosure and which illustrate, by way of example, principles of the fluid end as disclosed herein.

DESCRIPTION OF THE FIGURES

Notwithstanding any other forms which may fall within the scope of the fluid end as set forth in the Summary, specific embodiments of the fluid end and reciprocating pump will now be described, by way of example only, with reference to the accompanying drawings.

In the Description of the Figures and in the Detailed Description of Specific Embodiments, a pump that comprises three plunger, suction and discharge bores is hereafter referred to as a "triplex", and a pump that comprises five plunger, suction and discharge bores is hereafter referred to as a "quint", being an abbreviation of "quintuplex".

In the drawings:

FIGS. 1A and 1B illustrate, in sectional and perspective views, an embodiment of a reciprocating pump. FIG. 1A may depict either a triplex or quint, although FIG. 1B specifically depicts a triplex.

Figure 1A:
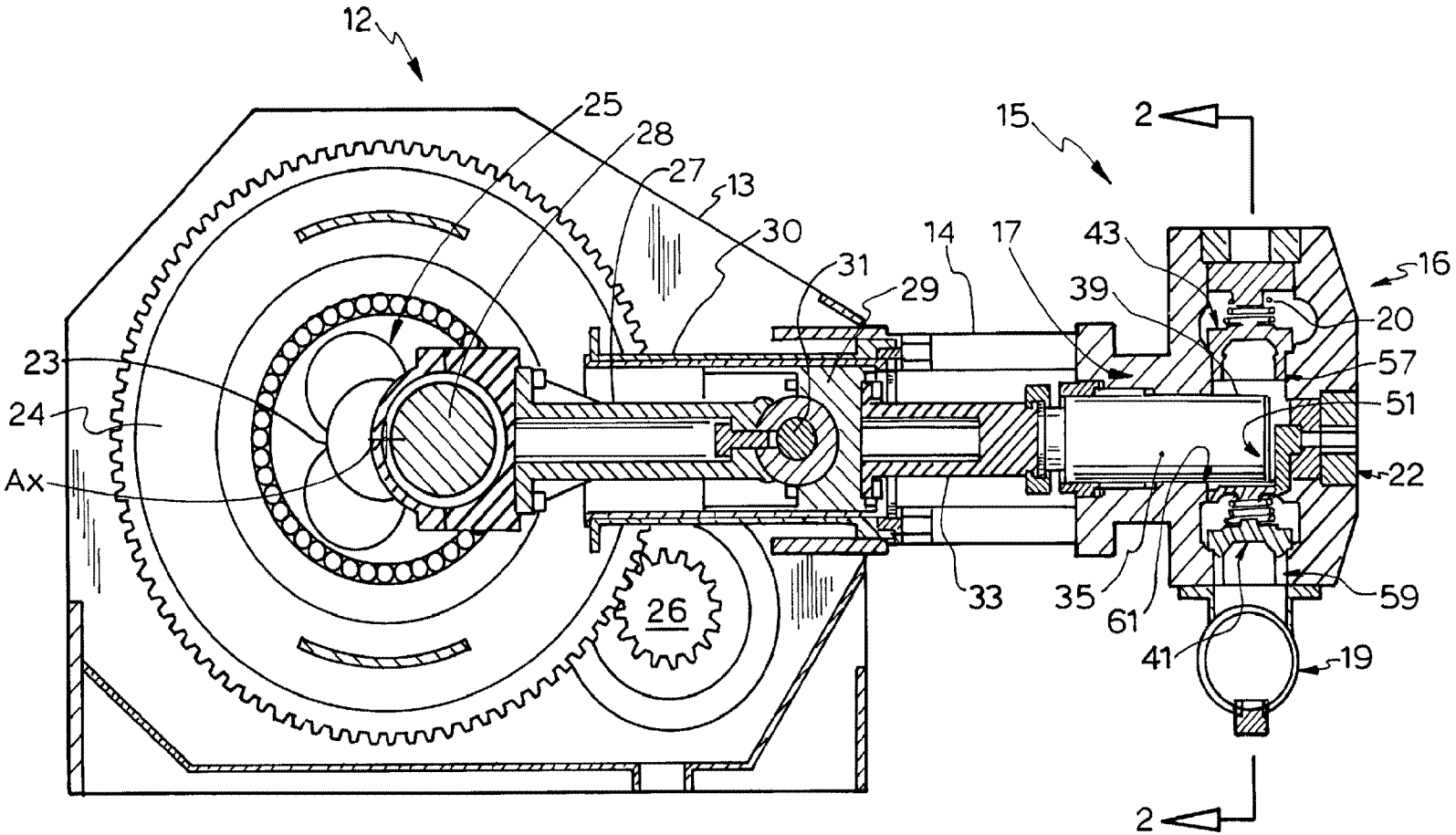
Figure 2:
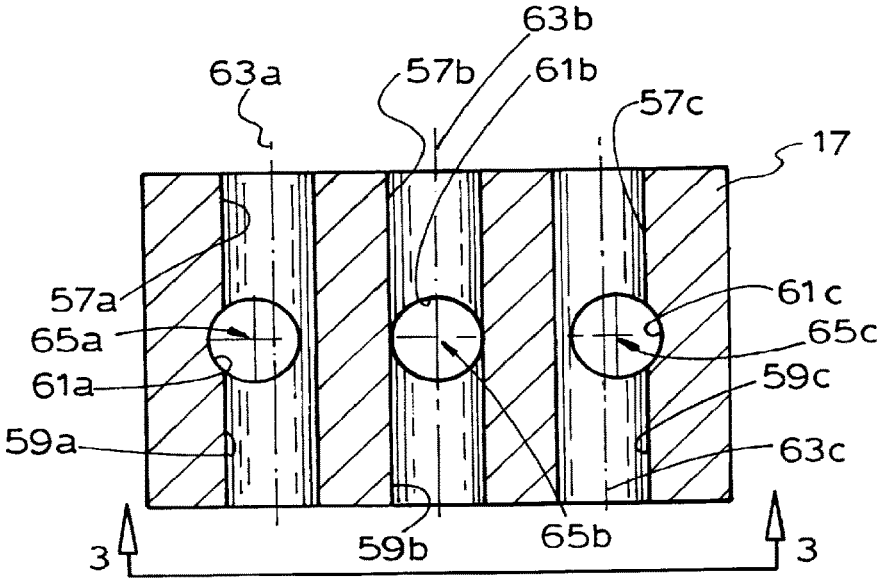

FIG. 2 schematically depicts a first embodiment of a triplex, being a partial section of FIG. 1A taken on the line 2-2, to illustrate both lateral (or outside) valve bore pairs being offset inwardly from their respective plunger bores.

Figure 3:
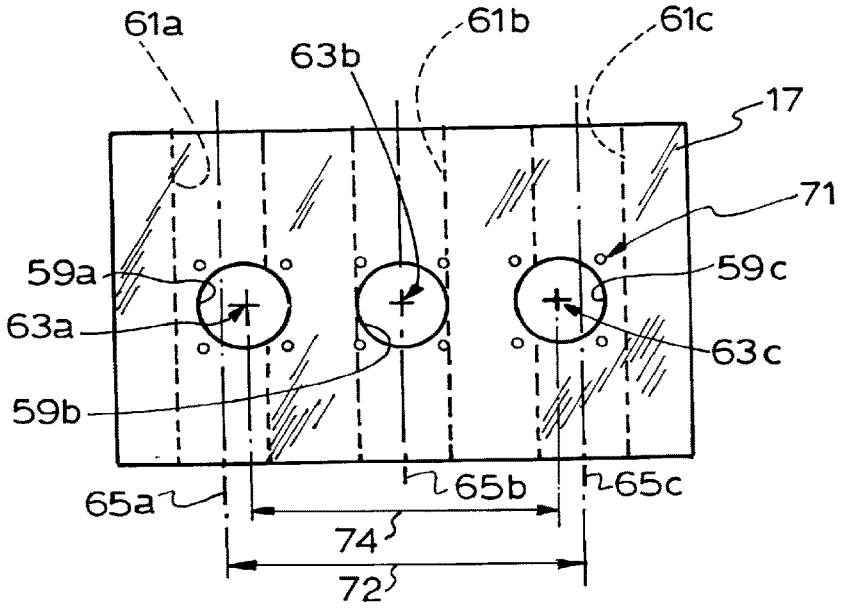

FIG. 3 is an underside schematic view of the section of FIG. 2 to show a bolt pattern on a fluid end of a cylinder.

Figure 4:
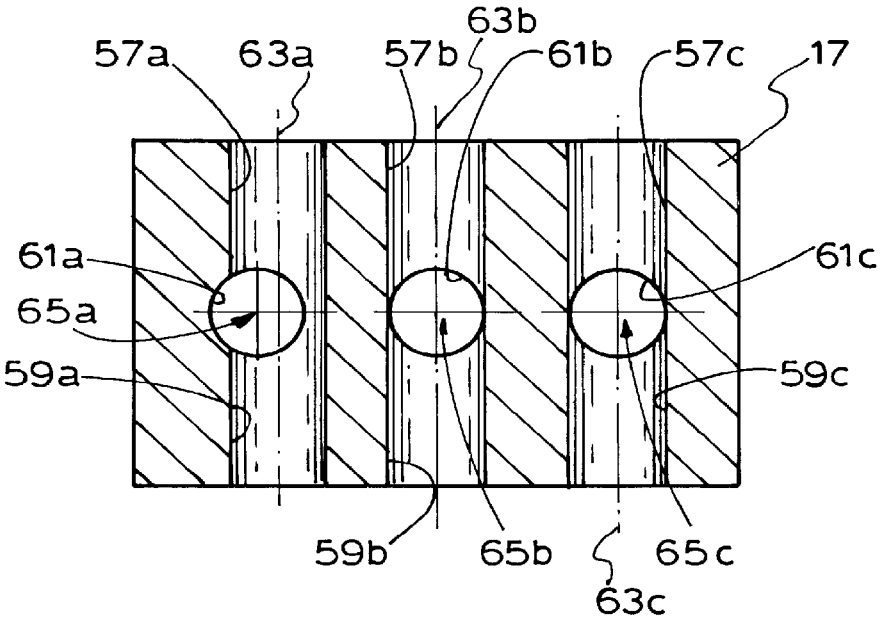

FIG. 4 is a similar view of the triplex to FIG. 2, but illustrates just one of the lateral (or outside) valve bore pairs being offset inwardly from its respective plunger bore.

Figure 5:
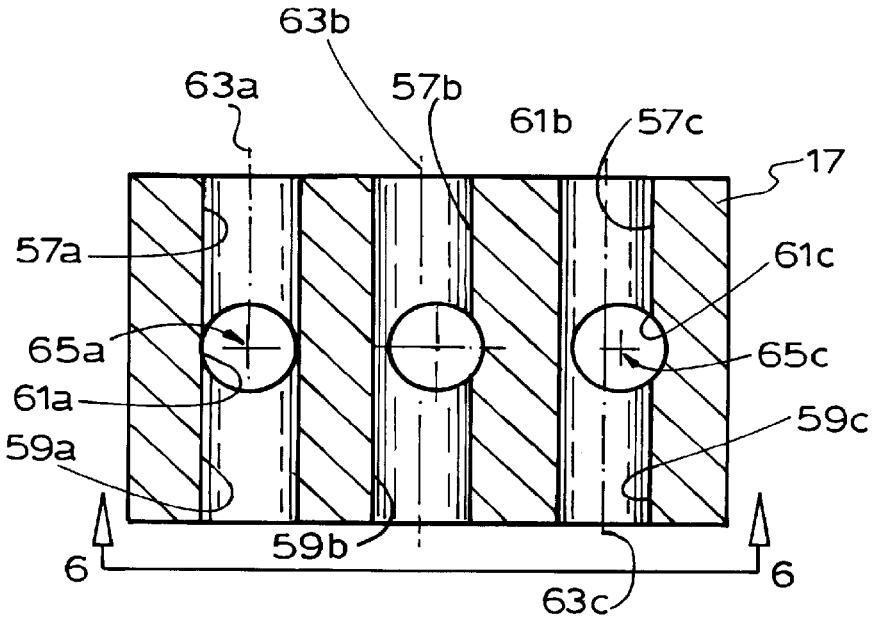

FIG. 5 schematically depicts another embodiment of a triplex but using a partial section similar to FIG. 2 to illustrate one of the lateral valve bores being inwardly offset to its respective plunger bore, as well as the central valve bore being offset in a similar direction to its respective plunger bores.

Figure 6:
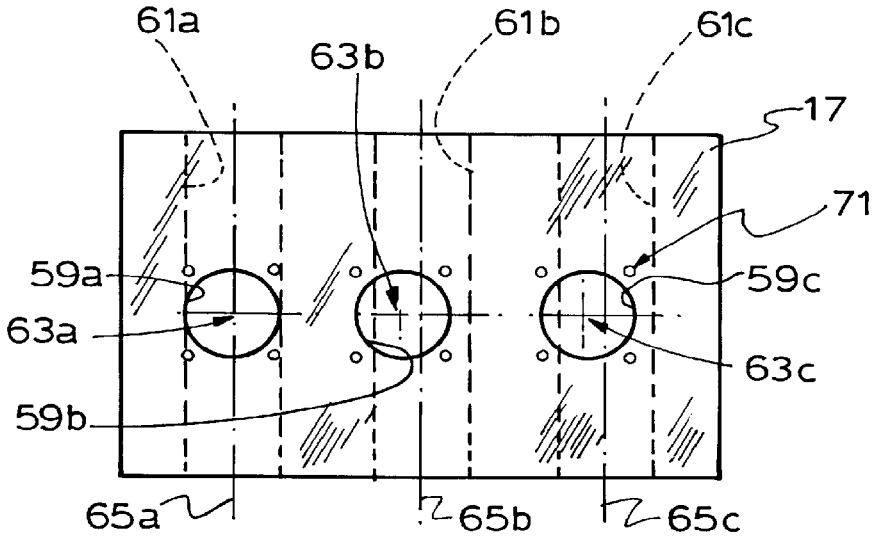

FIG. 6 is an underside schematic view of the section of FIG. 5 to show a bolt pattern on a fluid end of a cylinder.

Figure 7:
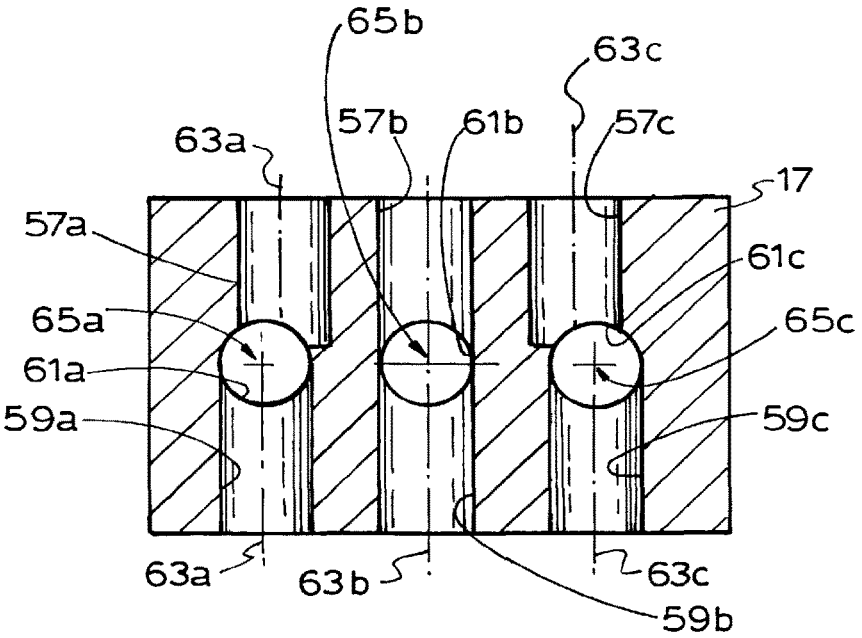

FIG. 7 schematically depicts another embodiment of a triplex using a partial section similar to FIG. 2, and wherein just the lateral discharge valve bores are inwardly offset from their respective plunger bores, and not the suction valve bores.

Figure 8:
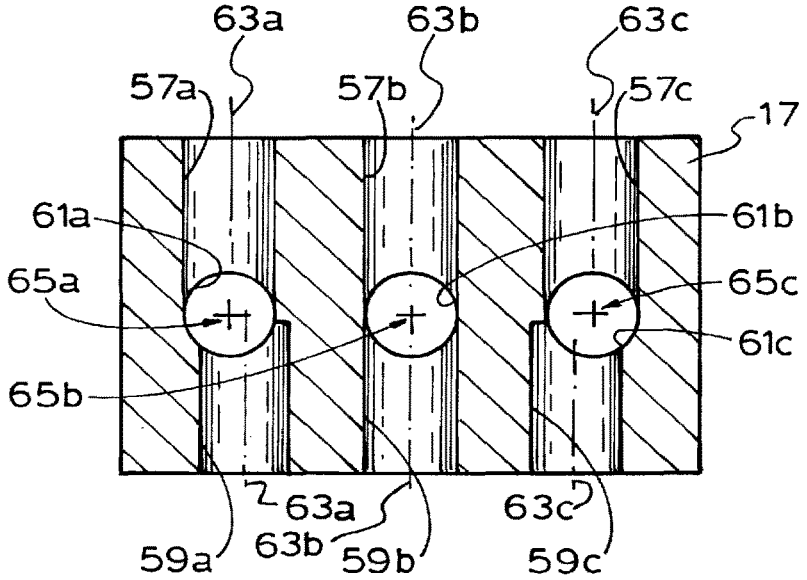

FIG. 8 schematically depicts another embodiment of a triplex using a partial section similar to FIG. 2, and wherein just the lateral suction valve bores are inwardly offset from their respective plunger bores, and not the discharge valve bores.

Figure 9:
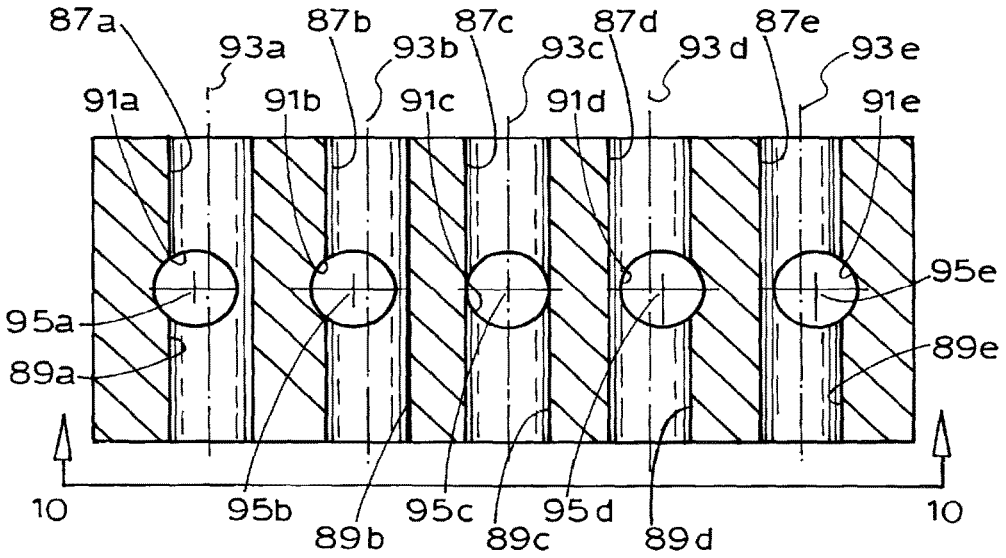

FIG. 9 schematically depicts a first embodiment of a quint, being a partial section of FIG. 1A taken on the line 2-2, to illustrate the two lateral valve bore pairs on either side of the central valve bore pair being offset inwardly from their respective plunger bores.

Figure 10:
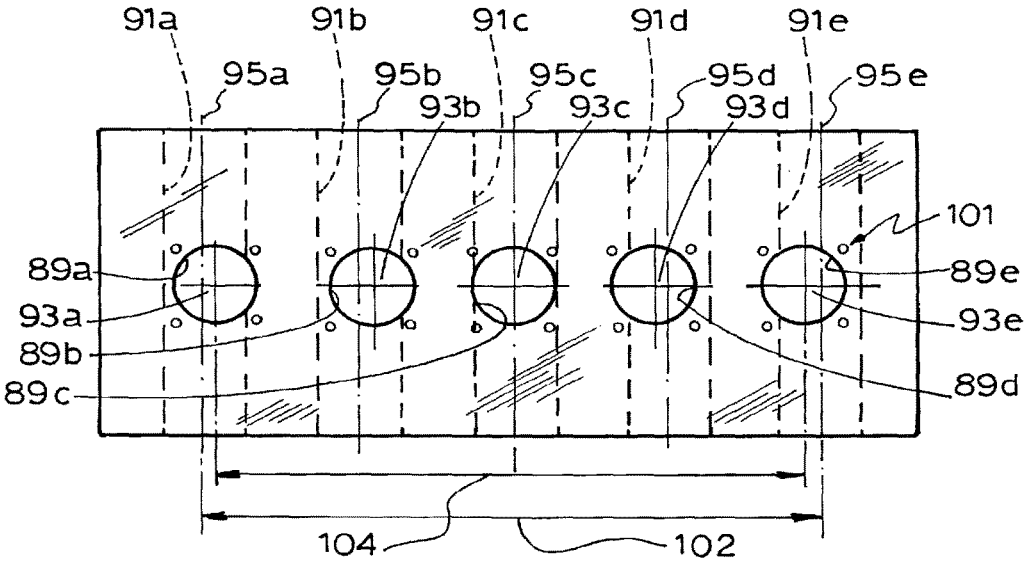

FIG. 10 is an underside schematic view of the section of FIG. 9 to show a bolt pattern on a fluid end of a cylinder.

Figure 11:
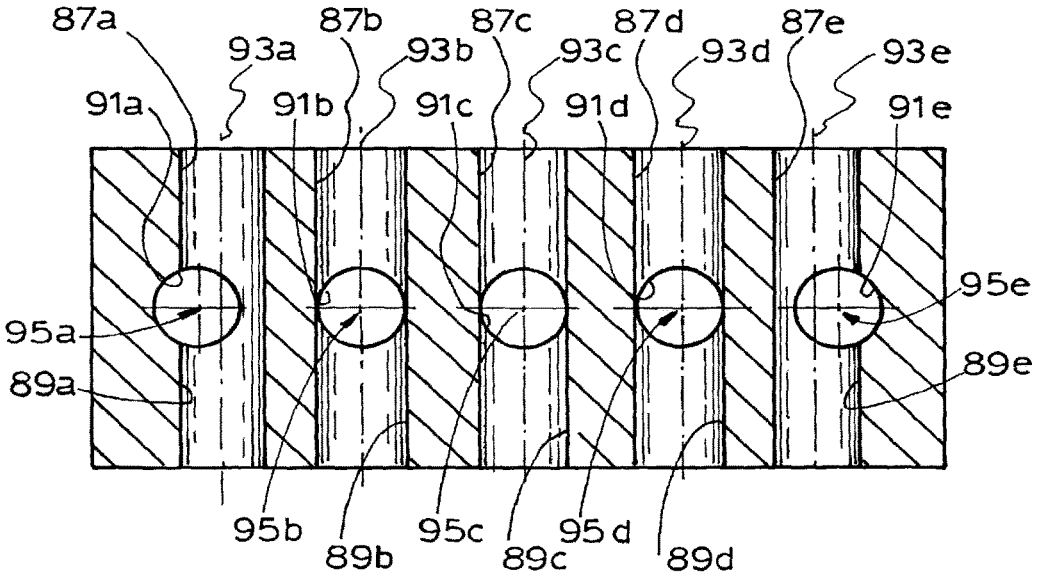

FIG. 11 is a similar view of the quint of FIG. 9, but illustrates just the outermost lateral valve bore pairs being offset inwardly from their respective plunger bore.

Figure 12:
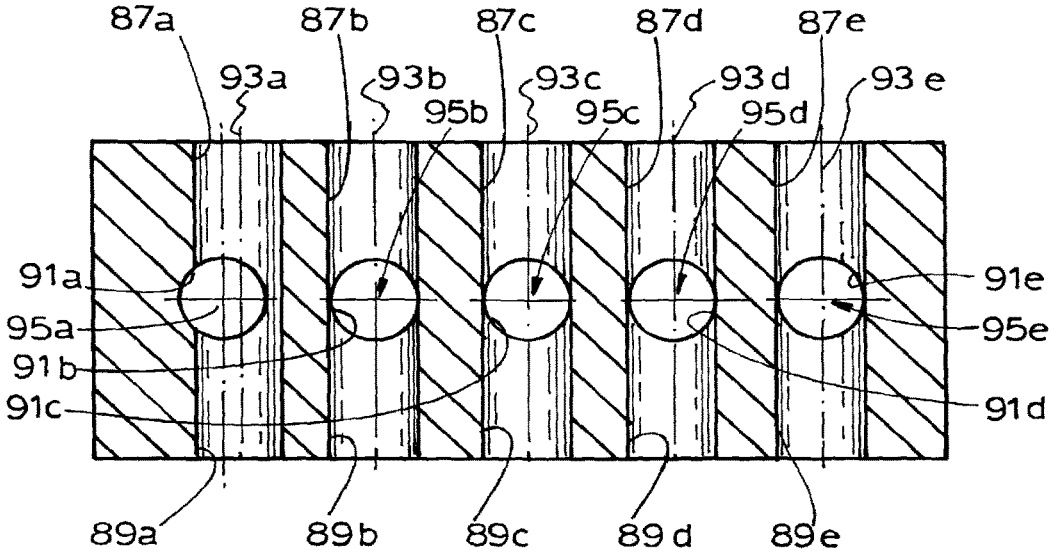

FIG. 12 is a similar view of the quint of FIG. 11, but illustrates just one of the outermost lateral valve bore pairs being offset inwardly from its respective plunger bore.

Figure 13:
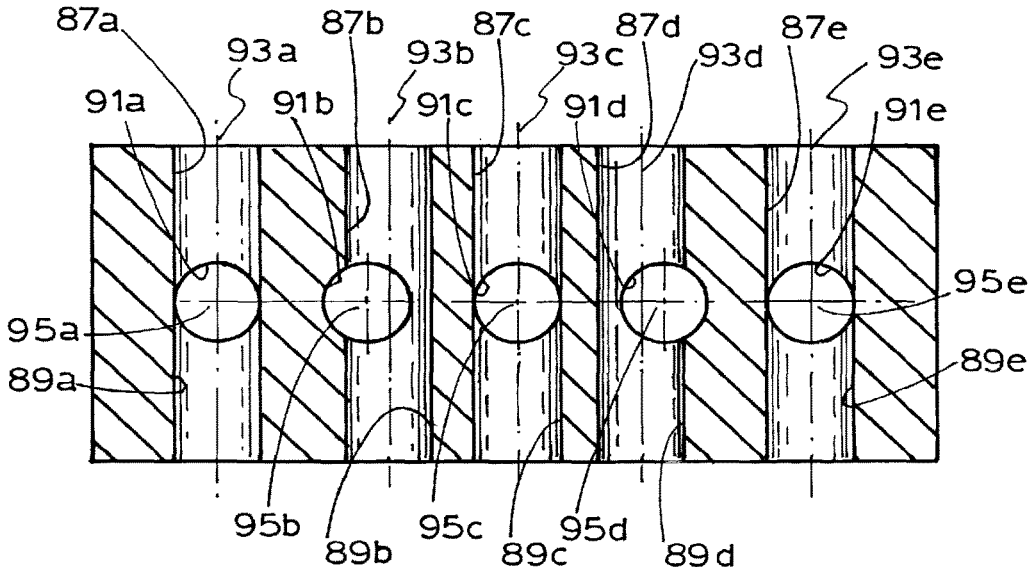

FIG. 13 is a similar view of the quint of FIG. 9, but illustrates just the innermost lateral valve bore pairs being offset inwardly from their respective plunger bore.

Figure 14:
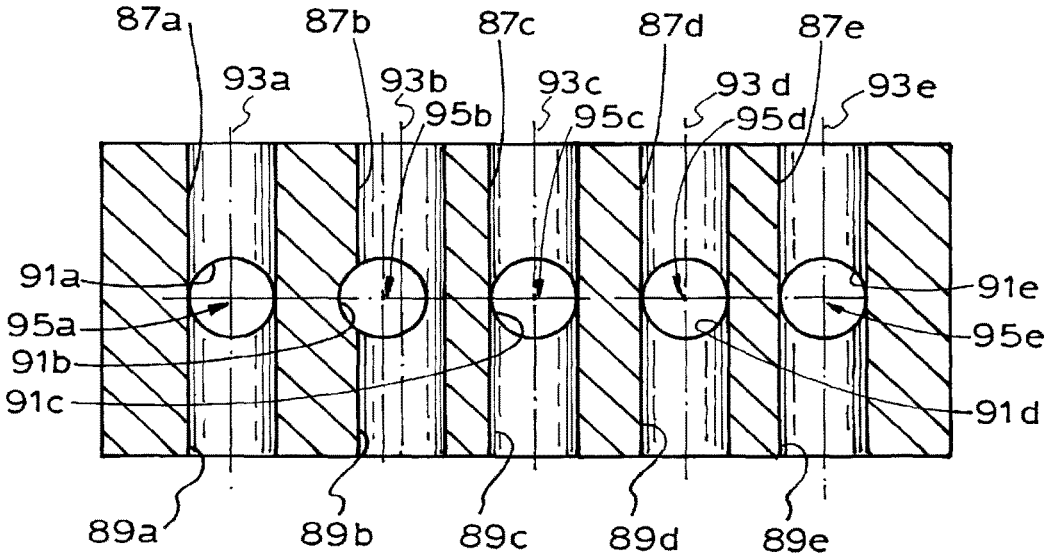

FIG. 14 is a similar view of the quint of FIG. 13, but illustrates just one of the innermost lateral valve bore pairs being offset inwardly from its respective plunger bore.

Figure 16:
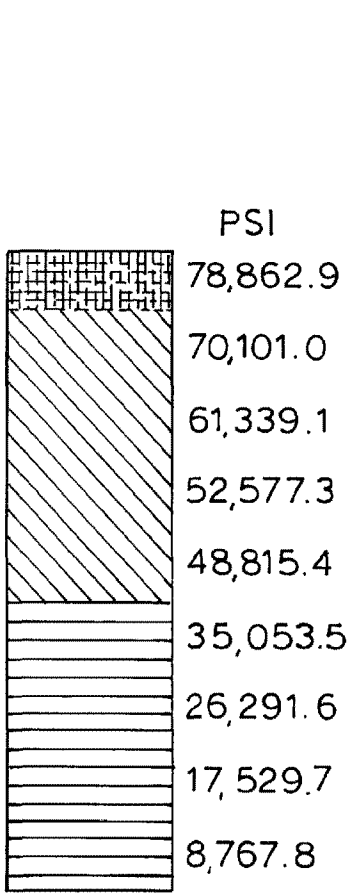
Figure 16:
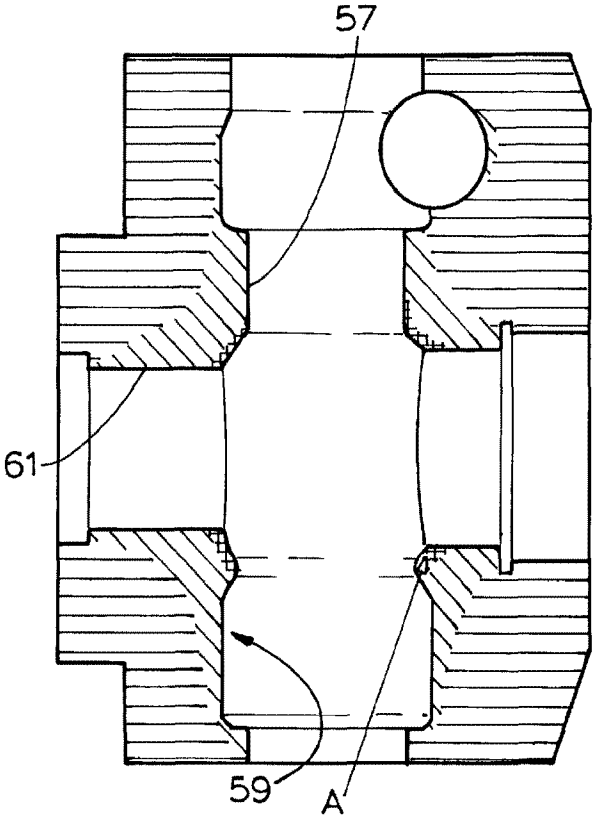
Figure 15:
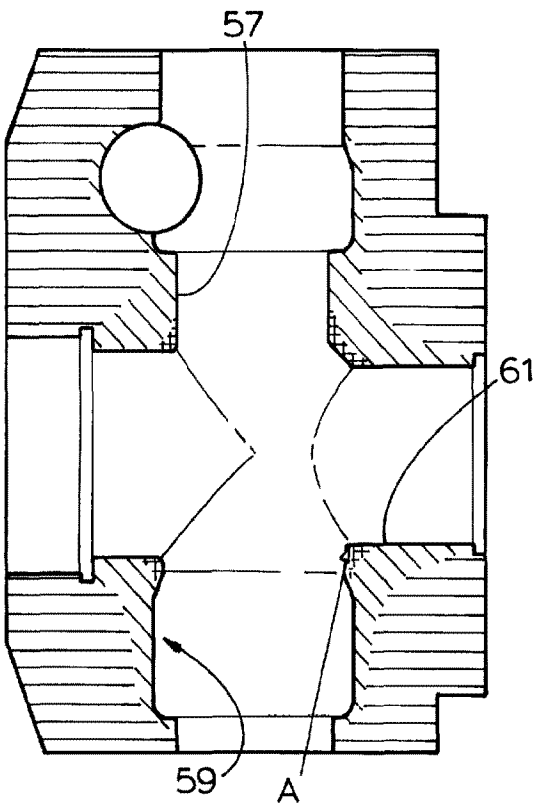

FIGS. 15 and 16 schematically depict side sectional elevations as generated by finite element analysis (FEA), and taken from opposite sides, through a triplex fluid end, to illustrate where maximum stress, as indicated by FEA, occurs for the intersection of a plunger bore with the suction and discharge valve bores; with FIG. showing no offset and FIG. 16 showing 2 inches inward offset.

Figure 17:
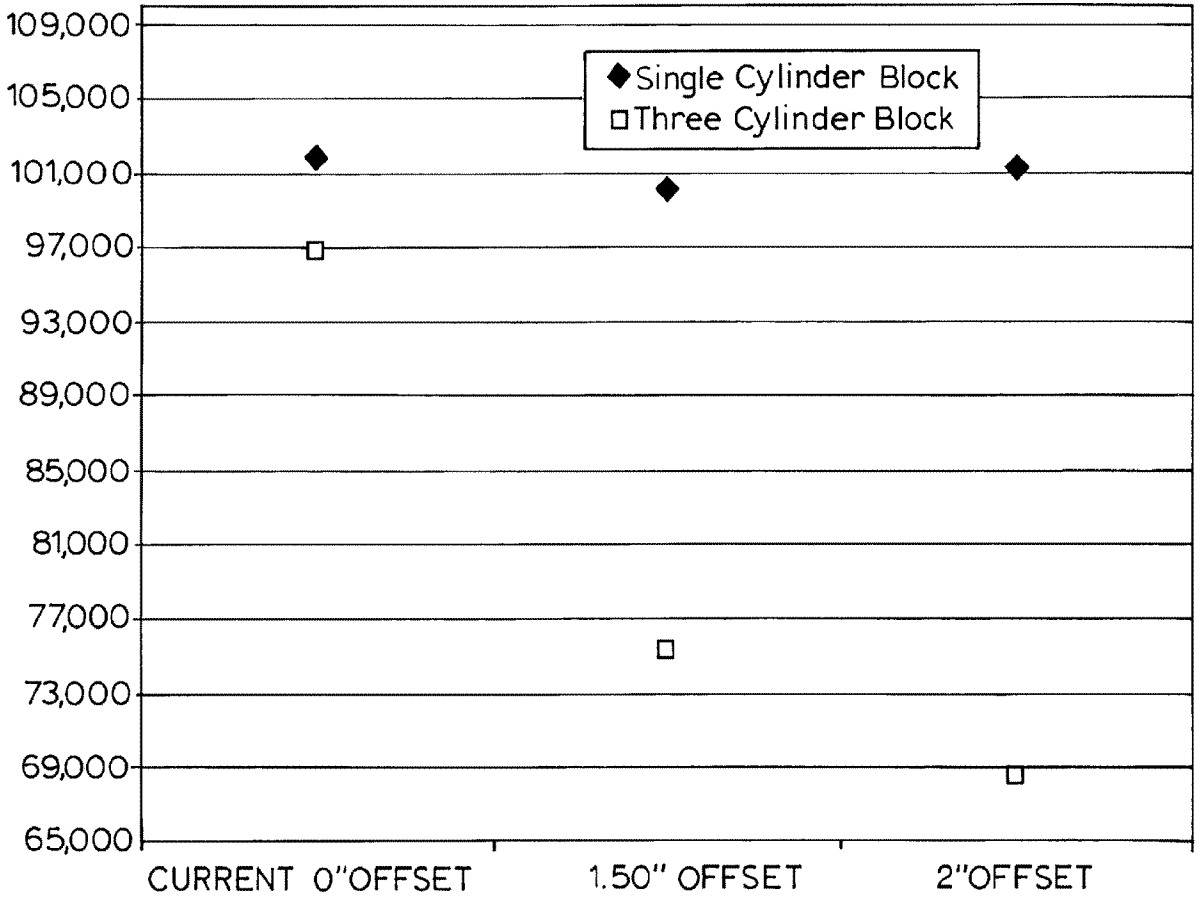

FIG. 17 is a data point graph that plot Von Mises yield criterion (that is, for the maximum stress, in psi, as determined by FEA) against the amount of valve bore offset (in inches) for a single (mono) fluid end and valve bore inward offset for a triplex fluid end.

Figure 18:
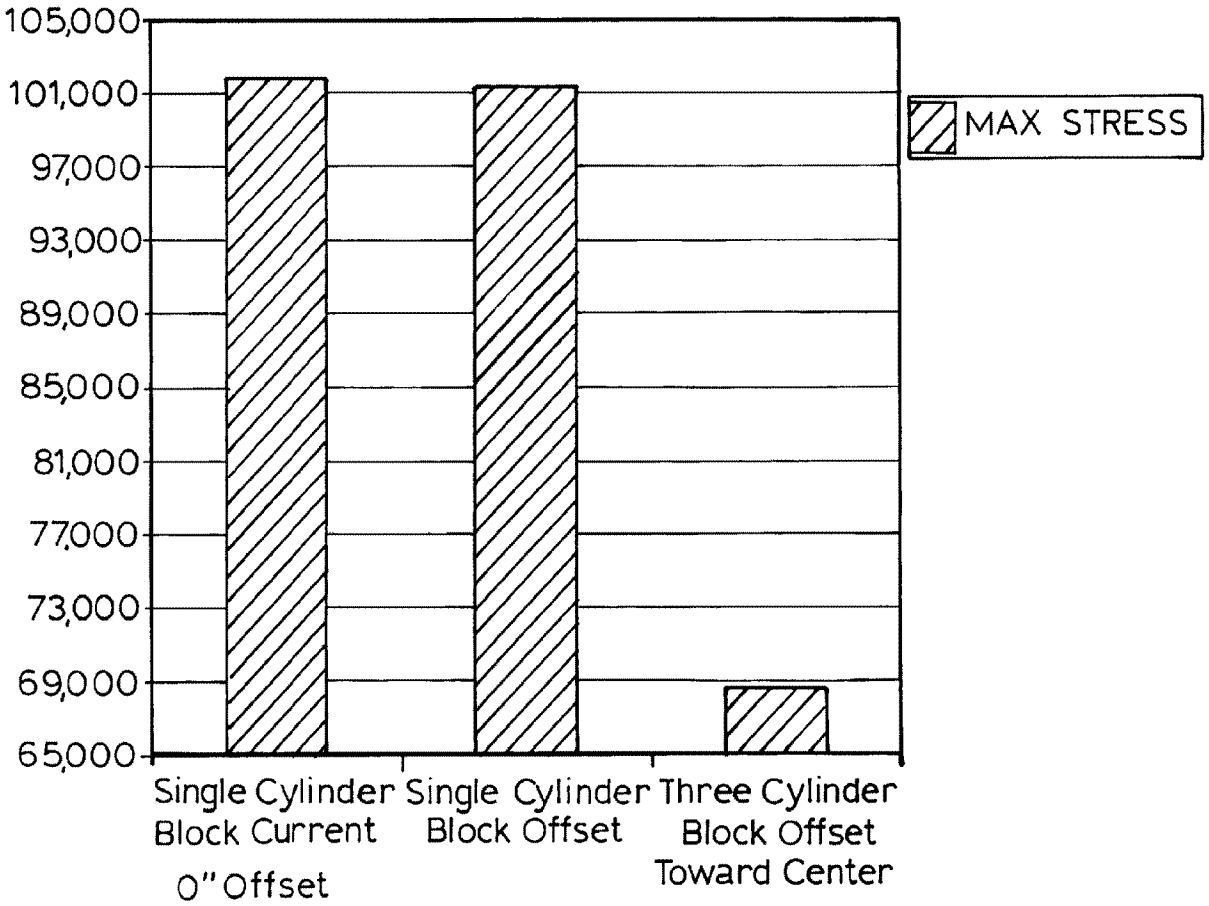

FIG. 18 is a bar graph that plots Von Mises yield criterion (that is, for the maximum stress, in psi, as determined by FEA) against different amounts of valve bore offset (in inches) for a single (mono) fluid end and a triplex fluid end.

DETAILED DESCRIPTION OF SPECIFIC EMBODIMENTS

Figure 1B:
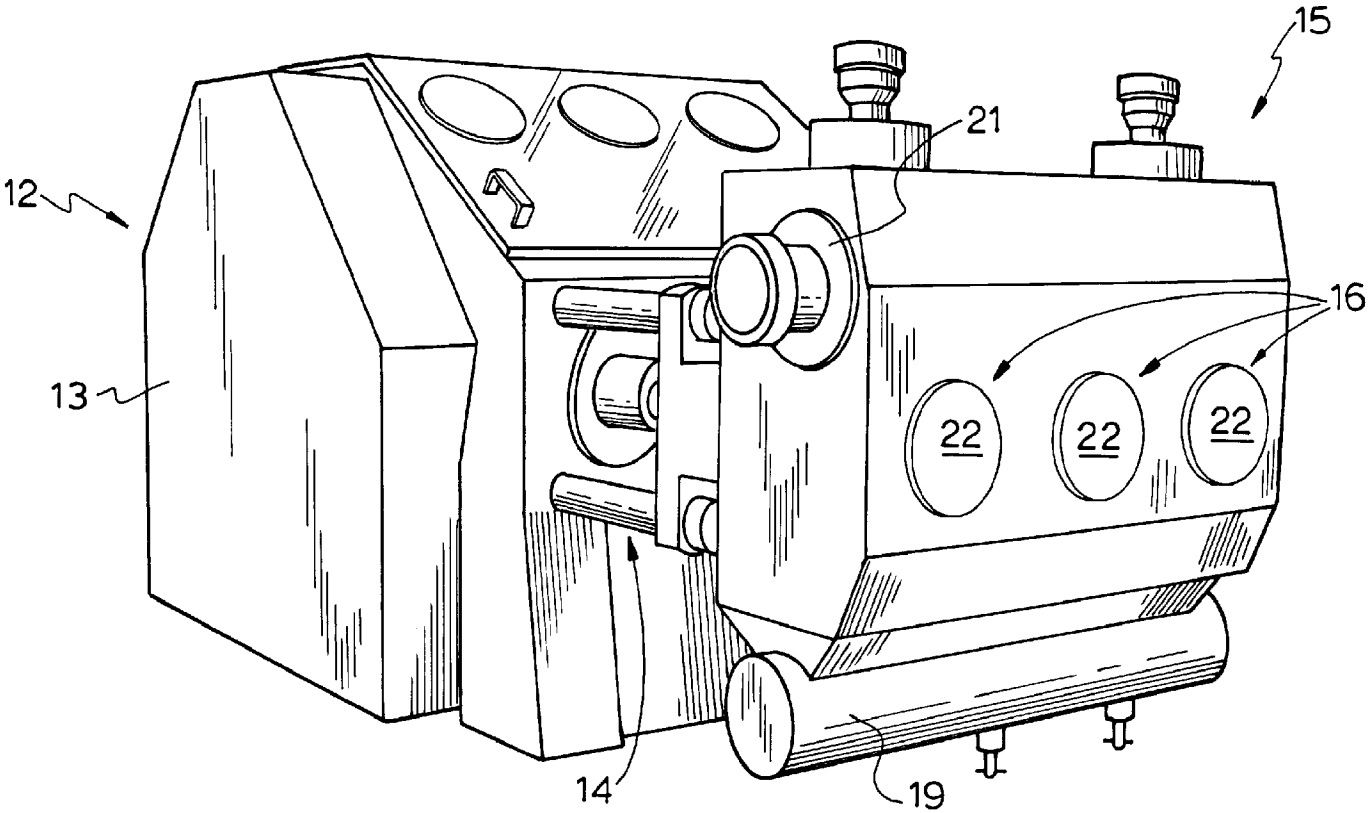

Referring to FIGS. 1A and 1B, an embodiment of a reciprocating pump 12 housed within a crankshaft housing 13 is shown. The crankshaft housing 13 may comprise a majority of the outer surface of reciprocating pump 12. Stay rods 14 connect the crankshaft housing 13 (the so-called "power end") to a fluid end 15. When the pump is to be used at high pressures (for instance, in the vicinity of 20,000 psi or greater), up to four stay rods can be employed for each plunger of the multiple reciprocating pump. The stay rods may optionally be enclosed in a housing.

The pump 12 is a triplex having a set of three cylinders 16, each including a respective plunger bore 17. The three (or, in the case of a quint, five) cylinders/plunger bores can be arranged transversely across the fluid end 15. A plunger 35 reciprocates in a respective plunger bore 17 and, in FIG. 1A, the plunger 35 is shown fully extended at its top dead centre position. In the embodiment depicted, fluid is only pumped at one side 51 of the plunger 35, therefore the reciprocating pump 12 is a single-acting reciprocating pump.

Each plunger bore 17 is in communication with a fluid inlet or suction manifold 19 and a fluid outlet side 20 in communication with a pump outlet 21 (FIG. 1B). A suction cover plate 22 for each cylinder 16 and plunger bore 17 is mounted to the fluid end 15 at a location that opposes the plunger bore 17. The pump 12 can be free-standing on the ground, can be mounted to a trailer that can be towed between operational sites, or mounted to a skid such as for offshore operations.

A crankshaft housing 13 encloses a crankshaft 25, which can be mechanically connected to a motor (not shown). The motor rotates the crankshaft 25 in order to drive the reciprocating pump 12. In one embodiment, the crankshaft 25 is cammed so that fluid is pumped from each cylinder 16 at alternating times. As is readily appreciable by those skilled in the art, alternating the cycles of pumping fluid from each of the cylinders 16 helps minimize the primary, secondary, and tertiary (et al.) forces associated with the pumping action.

A gear 24 is mechanically connected to the crankshaft 25, with the crankshaft 25 being rotated by the motor (not shown) through gears 26 and 24. A crank pin 28 attaches to the main shaft 23, shown substantially parallel to axis $A_X$ of the crankshaft 25. A connector rod 27 is connected to the crankshaft 25 at one end. The other end of connector rod 27 is secured by a bushing to a crosshead or gudgeon pin 31, which pivots within a crosshead 29 in housing 30 as the crankshaft 25 rotates at the one end of the connector rod 27. The pin 31 also functions to hold the connector rod 27 longitudinally relative to the crosshead 29. A pony rod 33 extends from the crosshead 29 in a longitudinally opposite direction from the crankshaft 25. The connector rod 27 and the crosshead 29 convert rotational movement of the crankshaft 25 into longitudinal movement of the pony rod 33.

The plunger 35 is connected to the pony rod 33 for pumping the fluid passing through each cylinder 16. Each cylinder 16 includes an interior or cylinder chamber 39, which is where the plunger 35 compresses the fluid being pumped by reciprocating pump 12. The cylinder 16 also includes an inlet (or suction) valve 41 and an outlet (or discharge) valve 43. Usually the inlet and outlet valves 41, 43 are arranged in an opposed relationship in cylinder 16 and may, for example, lie on a common axis.

The valves 41 and 43 are usually spring-loaded and are actuated by a predetermined differential pressure. The inlet (suction) valve 41 actuates to control fluid flow from the fluid inlet 19 into the cylinder chamber 39, and the outlet (discharge) valve 43 actuates to control fluid flow from the cylinder chamber 39 to the outlet side 20 and thence to the pump outlet 21. Depending on the size of the pump 12, the plunger 35 may be one of a plurality of plungers, for example, three or five plungers may be utilized.

The plunger 35 reciprocates, or moves longitudinally, toward and away from the chamber 39, as the crankshaft 25 rotates. As the plunger 35 moves longitudinally away from the cylinder chamber 39, the pressure of the fluid inside the chamber 39 decreases, creating a differential pressure across the inlet valve 41, which actuates the valve 41 and allows the fluid to enter the cylinder chamber 39 from the fluid inlet 19. The fluid continues to enter the cylinder chamber 39 as the plunger 35 continues to move longitudinally away from the cylinder 17 until the pressure difference between the fluid inside the chamber 39 and the fluid in the fluid inlet 19 is small enough for the inlet valve 41 to actuate to its closed position.

As the plunger 35 begins to move longitudinally into the cylinder 16, the pressure on the fluid inside of the cylinder chamber 39 begins to increase. Fluid pressure inside the cylinder chamber 39 continues to increase as the plunger 35 approaches the chamber 39 until the differential pressure across the outlet valve 43 is large enough to actuate the valve 43 and allow the fluid to exit the chamber 39 through the fluid outlet 21.

The inlet valve 41 is located within a suction valve bore 59 and the outlet valve 43 is located within a discharge valve bore 57. In the embodiment depicted, both valve bores 57, 59 are in communication with, and extend orthogonally to the plunger bore 17. The valve bores 57, 59 as shown are also co-axial (that is, lying on a common axis, or with parallel axes), but they may be offset relative to each other as described below.

It should be noted that the opposing arrangement of the valve bores 57, 59 depicted in FIG. 1 is easier to manufacture (for example, by casting and machining), and is easier to maintain and easier to service than, for example, a perpendicular arrangement of the valve bores (that is, where the axes of the bores are perpendicular). In the opposing bores arrangement, the bores can be easily accessed, packed, unpacked and serviced from under and above the fluid end, without interfering with the inlet and outlet manifolds.

In addition, it is understood that, where stress reduction in the fluid end is desirable, the opposing arrangement of the valve bores 57, 59 may induce less stress in the fluid end, especially at high operating pressures of 20,000 psi or greater, when compared with a perpendicular or other angled bore arrangement.

Referring now to FIG. 2, a partial sectional view of the fluid end 15 of the pump 12 taken on the line 2-2 of FIG. 1A is schematically depicted. In the embodiment of FIGS. 2 and 3, the pump 12 is a triplex having three plunger bores 17 corresponding to three cylinder bores. However, as described hereafter with reference to FIGS. 9 to 14, the pump can have a different number of cylinders and plunger bores, such as five. For a symmetric triplex fluid end, a central bore of the three plunger bores lies on a central axis of the fluid end, with the other two plunger bores arranged evenly on either side of the central plunger bore. Inward offset may be with respect to a central axis of the fluid end.

In the embodiment of FIGS. 2 and 3 each of the three plunger bores 17 is indicated schematically with the reference numeral 61 (that is, 61*a*, 61*b* and 61*c*); each of the three suction valve bores is indicated schematically with the reference numeral 59 (that is, 59*a*, 59*b* and 59*c*); and each of the three discharge valve bores is indicated schematically with the reference numeral 57 (that is, 57*a*, 57*b* and 57*c*). Similarly, the axis of each plunger bore 61 is indicated schematically with the reference numeral 65 (that is, 65*a*, 65*b* and 65*c*). Also, the common axis of each of the valve bores 59, 57 is indicated schematically with the reference numeral 63 (that is, 63*a*, 63*b* and 63*c*). This nomenclature will also be used hereafter with reference to each of the different triplex fluid end embodiments described herein in FIGS. 2 to 8.

It has been discovered that the highest point of stress concentration in pump 12 occurs at the intersection of a plunger bore with the suction (or inlet) and discharge (or outlet) valve bores. The maximum stress in the fluid end occurs when one plunger (for example, a lateral plunger) is approaching Top Dead Center (TDC), another is approaching Bottom Dead Center (BDC), and a third has just started moving from BDC to TDC.

It has further been discovered that, to reduce fluid end stress, some or all of the lateral (outside) valve bores 57*a*, 57*c*, 59*a*, 59*c* at the suction and discharge side may be inwardly offset so that an axis 65 of at least some of the plunger bores (that is, the lateral plunger bore axes 65*a*, 65*c*) does not intersect with a common valve bore axis 63, such that at least one of the lateral valve bore axis 63*a* or 63*c* is inwardly offset from its respective lateral plunger bore axes 65*a* or 65*c*. This inward lateral offset has been observed to noticeably reduce the stress in the fluid end 15 that arises as a result of fluid flowing therein, especially at the high pressures that can be employed in oilfield operations (for example, with oil well fracking fluid).

In the three cylinder triplex pump embodiment of FIGS. 2 and 3 the lateral (or outside) suction and discharge valve bores 59*a*, 57*a* and 59*c*, 57*c* are each shown as being inwardly offset and to the same extent from the associated lateral (or outside) plunger bores 61*a* and 61*c*. The central suction and discharge valve bores 59*b*, 57*b* are not offset from their respective plunger bores 61*b*. Thus, the terminology "offset inwardly and to the same extent" can be considered as meaning offset inwardly in relation, or with reference, to the central plunger bore 61*b* and central valve bores 57*b*, 59*b*. In addition, it will be seen that the common axis 63*a* of the valve bores 59*a*, 57*a* is offset inwardly from the axis 65*a* of plunger bore 61*a*. Further, it will be seen that the common axis 63*c* of the valve bores 59*c*, 57*c* is offset inwardly and to the same extent from the axis 65*c* of the plunger bore 61*c*.

Furthermore, whilst in this embodiment the amount of inward offset from both the lateral plunger bores and axes toward the central plunger bore and axis is the same, the amount of offset can be different. For example, the suction and discharge valve bores on one side can be more or less laterally offset to that of the suction and discharge valve bores on the other side of the fluid end. Additionally, either or both of the suction and discharge valve bores on one side may be laterally offset by different extents, or one may not be offset at all, and this offset may be different to each of the suction and discharge valve bores on the other side of the fluid end, which also may be offset differently to each other.

In any case, the inward offsetting of both the lateral suction and discharge valve bores 59*a*, 57*a* and 59*c*, 57*c*, by the same amount and to the same extent, has been surprisingly observed to maximize stress reduction within the fluid end at the high fluid operating pressures, as explained in Example 1.

As indicated above, in the three cylinder triplex pump embodiment of FIGS. 2 and 3, the common axis 63*b* of the central suction and discharge valve bores 59*b*, 57*b* intersects with axis 65*b* of the central plunger bore 61*b*. It has been observed that in a fluid end having three or more cylinders, there is less stress concentration at the intersection of the central plunger bore 61*b* with the central valve bores 57*b*, 59*b* as compared to the stress at the intersections of the lateral bores and their respective plungers, and hence offsetting the central valve bores 57*b*, 59*b* may not be required. However, the embodiments of FIGS. 5 and 6 provide that the central valve bores 59*b*, 57*b* and axes can also be offset (for example, maybe to a lesser degree than the lateral bores) to reduce stress concentration thereat.

In the embodiment of FIGS. 2 and 3, each common axis 63 of the valve bores 57 and 59 extends perpendicularly to the plunger bore axis 65, although the lateral axes 63*a* and 63*c* do not intersect.

The amount of inward offset of the valve bores 59, 57 and the plunger bores 61 can be significant. For example, for 4.5 inch diameter bores, the valve bore 59, 57, may be inwardly offset 2 inches from a respective plunger bore 61. The amount of inward offset may be measured from axis to axis. For example, the distance can be set by referring to the distance that the common axis 63*a* or 63*c* of the valve bores 57*a* or 57*c* and 59*a* or 59*c* is offset either from its respective plunger bore axis 65*a* or 65*c*, or from the central plunger bore axis 65*b* (or where the central valve bore is not offset, as offset from the central common axis 63*b* of the valve bores 57*b* and 59*b*).

In any case, the amount of the offset can be about 40% of the diameter of the plunger bore, though it can, for example, range from about 10% to about 60%. Where the inward offset of each of the lateral valve bores 59*a*, 59*c* and 57*a*, 57*c* is 2 inches, the distance from axis 63*a* of valve bores 59*a*, 57*c* to axis 63*c* of valve bores 59*c*, 57*c* thus becomes 4 inches closer than in known fluid ends of similar dimensions.

In other embodiments, the inward offset of each lateral valve bore can range from about 0.25 inch to about 2.5 inch; from about 0.5 inch to about 2.0 inch; from about 0.75 inch to about 2.0 inch; from about 1 inch to about 2 inch; from about 0.25 inch to about 1.25 inch; from about 1.5 inch to about 2.5 inch; from about 1.5 inch to about 2.0 inch; or from about 1.5 inch to about 1.75 inch.

This moving of the lateral valve bores inwardly can represent a significant reduction in the overall dimension and weight of the fluid end. However, one limit to the amount of inward offset of the lateral (or outside) valve bores toward the central valve bore can be the amount of supporting metal between the valve bores.

When the lateral (or outside) suction valve bores 59 are inwardly offset as described with reference to FIG. 2, modification of the suction manifold 19 (FIGS. 1A and 1B) can allow for its easy connection to the new fluid end 15. Similar modifications can be employed for the discharge manifold.

A conventional suction manifold corresponds to conventional bolt patterns that would be located at a greater distance than that occurring between the valve bores 59*a*, 57*a*, to valve bores 59*c*, 57*c* depicted in FIG. 2. The new bolt pattern 71 is illustrated in FIG. 3, which schematically depicts an underside of the fluid end 15. In this regard, the distance 74 of the axis 63*a* of the valve bore 59*a* to the axis 63*c* of the valve bore 59*c* is shorter than the distance 72 between the axis 65*a* of the plunger bore 61*a* to the axis 65*c* of the plunger bore 61*c*, the latter of which corresponds to the conventional bolt pattern. It is feasible to modify and utilize a manifold with the new bolt pattern.

Referring now to FIG. 4, a similar view of the triplex to FIG. 2 is provided, and like reference numerals are used to denote like parts. However, in this embodiment of the triplex, only one of the lateral (or outside) valve bores is offset inwardly from its respective plunger bore, with the other not being offset.

In FIG. 4 the lateral valve bores 57*a* and 59*a* are shown as being inwardly offset from their respective plunger bore 61*a*, 65*a* (that is, offset towards the central plunger bore axis 65*b*). In FIG. 4 the opposite lateral valve bores 57*c* and 59*c* are not offset from their respective plunger bore 61*c*.

In another embodiment shown in FIGS. 5 and 6, the suction valve bores 59*b*, 59*c* and the discharge valve bores 57*b*, 57*c* corresponding to the plunger bores 61*b*, 61*c* are offset to the left and to the same extent. The suction and discharge valve bores 59*a* and 57*a* corresponding to the plunger bore 65*a* are not offset.

Alternatively, the suction valve bores 59*a*, 59*b* and the discharge valve bores 57*a*, 57*b* corresponding to the plunger bores 61*a*, 61*b* may be offset to the right and to the same extent (not shown). In this alternative, the suction and discharge valve bores 59*c*, 57*c* that correspond to the plunger bore 61*a* would not be offset.

In the embodiment of FIGS. 5 and 6, an axis 63*b*, 63*c* of each of the valve bores 59*b*, 59*c* and 57*b*, 57*c* is offset to the left of an axis 65*b*, 65*c* of the respective plunger bores 61*b*, 61*c*. Due to the uniform offset of the valve bores 59*b*, 59*c*, 57*b*, 57*c* associated with each of the plunger bores 61*b*, 61*c*, an existing part of the manifold bolt pattern can be employed. However, for the non-offset valve bores 59*a*, 57*a*, in effect, a new (shifted) bolt pattern is required.

In another embodiment shown in FIG. 7, the lateral discharge valve bores 57*a* and 57*c* are shown being inwardly offset and to the same extent, while the central discharge valve bore 57*b* and the suction valve bores 59*a*, 59*b*, 59*c* all remain aligned with their respective plunger bores 61*a*, 61*b* and 61*c*. Thus, an axis 63*a*' and 63*c*' of each of the two lateral discharge valve bores 57*a* and 57*c* is offset from its respective plunger bore axis 65*a* and 65*c*, whereas the common axis 63*b* and the axes 63*a*" and 63*c*" of the lateral suction valve bores 59*a* and 59*c* intersect with their respective axes 65*a-c* of the plunger bores 61*a-c*. In this embodiment, the offset of the discharge valve bores 57*a* and 57*c* again provides a reduction in stress within the fluid end at these cross bore intersections.

Due to the non-uniform offset of the discharge valve bores, a conventional discharge manifold is not employed and instead a modified discharge manifold is bolted onto the discharge fluid end 15 of this embodiment. However, a conventional suction manifold may be employed.

In another embodiment shown in FIG. 8, the suction valve bores 59*a* and 59*c* are shown being inwardly offset and to the same extent, while the central suction valve bore 59*b* and the discharge valve bores 57*a*, 57*b*, 57*c* all remain aligned with their respective plunger bores 61*a*, 61*b* and 61*c*. Thus, an axis 63*a*" and 63*c*" of each of the two lateral suction valve bores 59*a* and 59*c* is offset from its respective plunger bore axis 65*a* and 65*c*, whereas the common axis 63*b* and the axes 63*a*' and 63*c*' of the lateral discharge valve bores 57*a*, 57*c* intersect with their respective axes 65*a-c* of the plunger bores 61*a-c*. In this embodiment, the offset of the suction valve bores 59*a* and 59*c* again provides a reduction in stress within the fluid end at these cross bore intersections.

Due to the non-uniform offset of the suction valve bores a conventional suction manifold is not employed and instead a modified suction manifold is bolted onto the suction fluid end 15 of this embodiment. However, a conventional discharge manifold may be employed.

It should be noted that the offsetting of just the lateral suction valve bores, or the offsetting of just the lateral discharge valve bores, can also be employed in a quint fluid end set-up, although this is not illustrated to avoid repetition.

Referring now to FIGS. 9 and 10, a first embodiment of a quint fluid end (that is, a quintuplex fluid end having five plungers, five suction valves and five discharge valve bores) is shown. FIG. 9 is a partial section of FIG. 1A taken on the line 2-2 (noting that FIG. 1A can also relate to a quint). FIG. 10 is an underside schematic view of the section of FIG. 9 to show a bolt pattern on a fluid end of a cylinder. For a symmetrical quint fluid end, a central bore of the five plunger bores lies on a central axis of the fluid end, with two plunger bores arranged evenly on either side of the central plunger bore. Again, inward offset may be with respect to a central axis of the fluid end.

In the embodiment of FIGS. 9 and 10 each of the five plunger bores 17 is indicated schematically with the reference numeral 91 (that is, 91*a*, 91*b*, 91*c*, 91*d* and 91*e*); each of the three suction valve bores is indicated schematically with the reference numeral 89 (that is, 89*a*, 89*b*, 89*c*, 89*d* and 89*e*); and each of the three discharge valve bores is indicated schematically with the reference numeral 87 (that is, 87*a*, 87*b*, 87*c*, 87*d* and 87*e*). Similarly, the axis of each plunger bore 91 is indicated schematically with the reference numeral 95 (that is, 95*a*, 95*b*, 95*c*, 95*d* and 95*e*). Also, the common axis of each of the valve bores 89, 87 is indicated schematically with the reference numeral 93 (that is, 93*a*, 93*b*, 93*c*, 93*d* and 93*e*). This nomenclature will also be used hereafter with reference to the different quint fluid end embodiments described herein.

In the quint fluid end embodiment of FIGS. 9 and 10 the two lateral valve bores 89*a* and 87*a*; 89*b* and 87*b*; 89*d* and 87*d*; 89*e* and 87*e* on each side of the central valve bores 89*c* and 87*c* are shown as being inwardly offset from their respective plunger bores 91*a*, 91*b*, 91*d* and 91*e*.

In the embodiment of FIGS. 9 and 10, each of the two lateral valve bores on either side of the central valve bores is inwardly offset by the same amount and to the same extent. However, with a quint fluid end, many more variations and offset combinations are possible than with a triplex fluid end. For example, just two of the lateral suction valve bores 89*a* and 89*b* (and not their respective discharge valve bores 87*a* and 87*b*) may be inwardly offset, and these two suction valve bores 89*a* and 89*b* may each be offset by the same or different amounts. This inward offset may, or may not, be employed for the opposite two lateral suction valve bores 89*d* and 89*e*. The inward offset may be employed for the opposite two lateral discharge valve bores 87*a* and 87*b*, which latter two might also each be offset by the same or by different amounts, and so on.

Referring to the new bolt pattern of FIG. 10, modification of the suction manifold can allow for its easy connection to the new quint fluid end. As mentioned above, a conventional suction manifold corresponds to conventional bolt patterns that are located at a greater distance than that occurring between the valve bores 89*a*, 87*a*, to valve bores 89*e*, 87*e* depicted in FIG. 10. The new bolt pattern 101 is illustrated in FIG. 10, which schematically depicts an underside of the fluid end 15. In this regard, the distance 104 of the axis 93*a* of the valve bore 89*a* to the axis 93*e* of the valve bore 89*e* is shorter than the distance 102 between the axis 95*a* of the plunger bore 91*a* to the axis 95*e* of the plunger bore 91*e*, the latter of which corresponds to the conventional bolt pattern. Again, it is feasible to modify and utilize a manifold with the new bolt pattern.

Referring now to FIG. 11, another embodiment of a quint fluid end is shown. FIG. 11 shows a similar view to the quint of FIG. 9, but in this embodiment illustrates the inward offsetting from their respective plunger bores 91*a* and 91*e* of just the outermost lateral valve bores 89*a* and 87*a* and 89*e* and 87*e* on each side of the central valve bores 89*c* and 87*c*. The other lateral valve bores 89*c* and 87*c* and 89*d* and 87*d* are not offset.

Referring now to FIG. 12, yet another embodiment of a quint fluid end is shown. FIG. 12 shows a similar view to the quint of FIG. 11, but in this embodiment illustrates the inward offsetting from its respective plunger bore 91*a* of just one of the outermost lateral valve bores 89*a* and 87*a*. The other lateral valve bores 89*b* and 87*b*, 89*d* and 87*d*, and 89*e* and 87*e* are not offset.

Referring now to FIG. 13, yet a further embodiment of a quint fluid end is shown. FIG. 13 shows a similar view to the quint of FIG. 9, but in this embodiment illustrates the inward offsetting from their respective plunger bores 91*a* and 91*e* of just the innermost lateral valve bores 89*b* and 87*b*, and 89*d* and 87*d*, on each side of the central valve bores 89*c* and 87*c*. The outermost lateral valve bores 89*a* and 87*a*, and 89*e* and 87*e* are not offset.

Referring now to FIG. 14, a yet further embodiment of a quint fluid end is shown. FIG. 14 shows a similar view to the quint of FIG. 13, but in this embodiment illustrates the inward offsetting from its respective plunger bore 91*a* of just one of the innermost lateral valve bores 89*b* and 87*b*. The other lateral valve bores 89*a* and 87*a*, 89*d* and 87*d*, and 89*e* and 87*e* are not offset.

Example

A non-limiting example will now be provided to illustrate how the inward offsetting of a lateral valve bore was predicted by finite element analysis (FEA) to reduce the overall amount of stress in a fluid end in operation. In the following example, the FEA tests were conducted for a triplex fluid end, although it was noted that the findings also applied to a quintuplex fluid end.

The FEA experiments were conducted to compare the stresses induced in a number of new fluid end configurations having three cylinders against a known (existing and unmodified) three cylinder fluid end configuration. In the known fluid end configuration the axis of each plunger bore intersected perpendicularly with a common axis of the suction and discharge valve bores.

In these FEA stress tests, each fluid end was subjected to a working fluid pressure of 15,000 psi, commensurate with that experienced in usual applications. The pressure of fluid in the lateral discharge bore was observed by FEA to be 16,800 psi.

FIGS. 15 and 16 show two of the schematics of a triplex fluid end that were generated by FEA at these model fluid pressures. The view in FIG. 15 is from one side of the fluid end and shows no offset of the discharge and suction valve bores 59 and 57. The head of the lower arrow illustrates where maximum stress occurred at the intersection of the plunger bore 61 with the suction valve bore 57 (that is, where the suction valve bore 57 intersects with the extension of the plunger bore 61 which terminates at the suction cover plate 22).

The view in FIG. 16 is from an opposite side of the fluid end and shows a 2 inch inward offset of the discharge and suction valve bores 59 and 57. The head of the arrow A illustrates where maximum stress occurred at the intersection of the plunger bore 61 with the suction valve bore 57 (that is, where the plunger bore 61 first intersects with the suction valve bore 57). This indicates that, in operation, stress in the fluid end may be reduced, for example, by the inward offsetting just one of the suction valve bores 59. However, greater stress reduction may also be achieved by the inward offsetting of the opposing lateral suction and discharge valve bores 59 and 57.

Example 1

In the FEA stress tests, a single (or mono) block fluid end and a triplex fluid end were each modeled. The triplex fluid end configurations modeled included one lateral suction valve bore 59 and one discharge valve bore 57 each being inwardly offset by 1.5 inches and by 2 inches as indicated in FIG. 17. Each stress result predicted by FEA was correlated to the Von Mises yield criterion (in psi) and the results were plotted for each of zero offset (that is, an existing fluid end), and 1.5 inch and 2 inch offset (that is, a new fluid end). With the single block fluid end, the suction and discharge valve bores were offset from the plunger bore.

The stress result predicted by FEA was correlated to the Von Mises yield criterion (in psi) and the results were plotted for each of 0 inch offset (that is, an existing fluid end), and 1.5 inch and 2 inch offset (that is, new fluid end). The results are shown in the graphs of FIG. 17 (which shows data point results for both 1.5 inch and 2 inch offset) and FIG. 18 (which represents the results for 1.5 inch and 2 inch inward offset in a bar chart).

As can be seen, FEA predicted that the greatest amount of stress reduction occurred with the 2 inch inward offset configuration of the valve bores in a triplex. For a single block fluid end the modeling of offset did not produce much of reduction in stress.

The overall stress reduction in the triplex fluid end for a 2 inch inward offset was noted to be approximately 30% (that is, from ~97,000 psi to less than 69,000 psi as shown in FIGS. 17 and 18). It was noted that such a stress reduction would be likely to significantly extend the useful operating life, of the fluid end.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below", "top" and "bottom" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the fluid end and reciprocating pump, and alterations, modifications, additions and/or changes can be made thereto without departing from the scope and spirit of the disclosed embodiments, the embodiments being illustrative and not restrictive.

Furthermore, the fluid end and reciprocating pump have described in connection with what are presently considered to be the most practical and preferred embodiments, it is to be understood that the fluid end and reciprocating pump are not to be limited to the disclosed embodiments, but on the contrary, is intended to cover various modifications and equivalent arrangements included within the spirit and scope of the disclosure. Also, the various embodiments described above may be implemented in conjunction with other embodiments, for example, aspects of one embodiment may be combined with aspects of another embodiment to realize yet other embodiments. Further, each independent feature or component of any given assembly may constitute an additional embodiment.

What is claimed is:

1. An apparatus comprising a fluid end, the fluid end comprising:

opposing first and second side portions horizontally spaced from each other;

a pump chamber horizontally located between the first and second side portions, wherein fluid is adapted to be pressurized within the pump chamber;

a first flowpath located below the pump chamber and defining a first longitudinal center axis extending between opposite ends of the first flowpath, wherein the fluid is adapted to be conveyed into the pump chamber via the first flowpath;

a first plunger bore in fluid communication with the pump chamber, the first plunger bore defining a second longitudinal axis along which a first plunger is adapted to reciprocate, wherein the second longitudinal axis is perpendicular to the first longitudinal axis; and a second flowpath located above the pump chamber and opposing the first flowpath, the second flowpath defining a third longitudinal center axis that is perpendicular to the second longitudinal center axis and extends between opposite ends of the second flowpath, wherein the fluid is adapted to be conveyed out of the pump chamber via the second flowpath;

wherein the second longitudinal center axis is horizontally spaced from at least one of the first and third longitudinal center axes defined by the first and second flowpaths, respectively, such that a plunger horizontal spacing is defined between the second longitudinal center axis and the at least one of the third and first longitudinal center axes; and wherein:

the at least one of the first and third longitudinal center axes and the corresponding one of the first and second flowpaths including said ends thereof are located horizontally between:

the second longitudinal center axis, and an additional longitudinal center axis along which an additional plunger is adapted to reciprocate, the additional longitudinal center axis being spaced in a parallel relation from the second longitudinal center axis and being located horizontally between the second side portion and the second longitudinal center axis, the second longitudinal center axis is located closer to the first side portion of the fluid end than the second side portion, and a first horizontal distance between the first side portion and each of the first and third longitudinal center axes is greater than a second horizontal distance between the first side portion and the second longitudinal center axis.

2. The apparatus of claim 1, further comprising a first valve located in the first flowpath, wherein the first valve is actuable between a first closed position and a first open position.

3. The apparatus of claim 2, further comprising a second valve that is located in the second flowpath, and that is opposed to the first valve located in the first flowpath, wherein the second valve is actuable between a second closed position and a second open position.

4. The apparatus of claim 3, wherein the fluid is adapted to be conveyed into the pump chamber, via the first flowpath, when the first valve is in the first open position and the second valve is in the second closed position.

5. The apparatus of claim 4, wherein the fluid is adapted to be conveyed out of the pump chamber, via the second flowpath, when the first valve is in the first closed position and the second valve is in the second open position.

6. The apparatus of claim 5, further comprising the first plunger that is adapted to reciprocate along the second longitudinal axis defined by the first plunger bore;

wherein the first plunger is adapted to reciprocate and thus move away from, and toward, the pump chamber; and wherein the first valve located below the pump chamber is adapted to be actuated to the first open position in response to the plunger moving away from the pump chamber.

7. The apparatus of claim 6, wherein the movement of the plunger away from the pump chamber is adapted to create a pressure differential across the first valve so that a first pressure in a portion of the first flowpath vertically located below the first valve in its entirety is greater than a second pressure in at least a portion of the pump chamber vertically located above the first valve in its entirety.

8. The apparatus of claim 6, wherein the second valve located above the pump chamber is adapted to be actuated to the second open position in response to the plunger moving toward the pump chamber.

9. The apparatus of claim 1, further comprising a crankshaft housing connected to the fluid end; and a plurality of stay rods connecting the crankshaft housing to the fluid end.

10. The apparatus of claim 1, wherein the third longitudinal center axis is coaxial with the first longitudinal center axis so that:

the plunger horizontal spacing is defined between the second longitudinal center axis and both of the coaxial third and first longitudinal center axes; and the coaxial first and third longitudinal center axes and the first and second flowpaths including said ends thereof are located horizontally between:

the second longitudinal center axis, and the additional longitudinal center axis along which the additional plunger is adapted to reciprocate;

and the first horizontal distance is defined between the first side portion and both of the coaxial first and third longitudinal center axes.

11. The apparatus of claim 1, wherein the second longitudinal center axis is horizontally spaced from the first longitudinal center axis so that:

the plunger horizontal spacing is defined between the second longitudinal center axis and the first longitudinal center axis; and the first longitudinal center axis and the first flowpath including said ends thereof are located horizontally between:

the second longitudinal center axis, and the additional longitudinal center axis along which the additional plunger is adapted to reciprocate, and the first horizontal distance is defined between the first side portion and the first longitudinal center axis.

12. The apparatus of claim 1, wherein the second longitudinal center axis is horizontally spaced from the third longitudinal center axis so that:

the plunger horizontal spacing is defined between the second longitudinal center axis and the third longitudinal center axis; and the third longitudinal center axis and the second flowpath including said ends thereof are located horizontally between:

the second longitudinal center axis, and the additional longitudinal center axis along which the additional plunger is adapted to reciprocate, and the first horizontal distance is defined between the first side portion and the third longitudinal center axis.

13. The apparatus of claim 1, further comprising:

a suction manifold connected to the fluid end.

14. An apparatus, comprising:

a fluid end, comprising:

opposing first and second side portions horizontally spaced from each other;

a pump chamber horizontally located between the first and second side portions, wherein fluid is adapted to be pressurized within the pump chamber;

a first flowpath located below the pump chamber and defining a first longitudinal center axis extending between opposite ends of the first flowpath, wherein the fluid is adapted to be conveyed into the pump chamber via the first flowpath;

a first plunger bore in fluid communication with the pump chamber, the first plunger bore defining a second longitudinal axis along which a first plunger is adapted to reciprocate, wherein the second longitudinal axis is perpendicular to the first longitudinal axis; and a second flowpath located above the pump chamber and opposing the first flowpath, the second flowpath defining a third longitudinal center axis that is perpendicular to the second longitudinal center axis and extends between opposite ends of the second flowpath, wherein the fluid is adapted to be conveyed out of the pump chamber via the second flowpath;

wherein the second longitudinal center axis is horizontally spaced from the first longitudinal center axis defined by the first flowpath; the third longitudinal center axis is coaxial with the first longitudinal center axis; and a plunger horizontal spacing is defined between the second longitudinal center axis and both of the coaxial third and first longitudinal center axes; and wherein:

the coaxial first and third longitudinal center axes and the first and second flowpaths including said ends thereof are located horizontally between:

the second longitudinal center axis, and an additional longitudinal center axis along which an additional plunger is adapted to reciprocate, the additional longitudinal center axis being spaced in a parallel relation from the second longitudinal center axis and being located horizontally between the second side portion and the second longitudinal center axis, the second longitudinal center axis is located closer to the first side portion of the fluid end than the second side portion, and a first horizontal distance between the first side portion and both of the coaxial first and third longitudinal center axes is greater than a second horizontal distance between the first side portion and the second longitudinal center axis;

a first valve located in the first flowpath, wherein the first valve is actuable between a first closed position and a first open position;

and a second valve that is located in the second flowpath, and that is opposed to the first valve located in the first flowpath, wherein the second valve is actuable between a second closed position and a second open position;

wherein the fluid is adapted to be conveyed into the pump chamber, via the first flowpath, when the first valve is in the first open position and the second valve is in the second closed position; and wherein the fluid is adapted to be conveyed out of the pump chamber, via the second flowpath, when the first valve is in the first closed position and the second valve is in the second open position.

15. The apparatus of claim 14, further comprising the first plunger that is adapted to reciprocate along the second longitudinal axis defined by the first plunger bore;

wherein the first plunger is adapted to reciprocate and thus move away from, and toward, the pump chamber; and wherein the first valve located below the pump chamber is adapted to be actuated to the first open position in response to the plunger moving away from the pump chamber.

16. The apparatus of claim 15, wherein the movement of the plunger away from the pump chamber is adapted to create a pressure differential across the first valve so that a first pressure in a portion of the first flowpath vertically located below the first valve in its entirety is greater than a second pressure in at least a portion of the pump chamber vertically located above the first valve in its entirety.

17. The apparatus of claim 16, wherein the second valve located above the pump chamber is adapted to be actuated to the second open position in response to the plunger moving toward the pump chamber.

18. The apparatus of claim 14, further comprising a crankshaft housing connected to the fluid end; and a plurality of stay rods connecting the crankshaft housing to the fluid end.

19. The apparatus of claim 14, further comprising:

a suction manifold connected to the fluid end.

20. A reciprocating pump, comprising:

a crankshaft adapted to be operably coupled to a motor;

a connector rod connected to the crankshaft;

a crosshead connected to the connector rod;

a pony rod extending from the crosshead;

a plunger adapted to be connected to the pony rod and reciprocate in response to rotation of the crankshaft;

a fluid end comprising a plunger bore within which the plunger is adapted to reciprocate, the fluid end further comprising:

opposing first and second side portions horizontally spaced from each other;

a pump chamber horizontally located between the first and second side portions, wherein fluid is adapted to be pressurized within the pump chamber;

a first flowpath located below the pump chamber and defining a first longitudinal center axis extending between opposite ends of the first flowpath, wherein the fluid is adapted to be conveyed into the pump chamber via the first flowpath;

a first plunger bore in fluid communication with the pump chamber, the first plunger bore defining a second longitudinal axis along which a first plunger is adapted to reciprocate, wherein the second longitudinal axis is perpendicular to the first longitudinal axis; and a second flowpath located above the pump chamber and opposing the first flowpath, the second flowpath defining a third longitudinal center axis that is perpendicular to the second longitudinal center axis and extends between opposite ends of the second flowpath, wherein the fluid is adapted to be conveyed out of the pump chamber via the second flowpath;

wherein the second longitudinal center axis is horizontally spaced from the first longitudinal center axis defined by the first flowpath; the third longitudinal center axis is coaxial with the first longitudinal center axis; and a plunger horizontal spacing is defined between the second longitudinal center axis and both of the coaxial third and first longitudinal center axes; and wherein:

the coaxial first and third longitudinal center axes and the first and second flowpaths including said ends thereof are located horizontally between:

the second longitudinal center axis, and an additional longitudinal center axis along which an additional plunger is adapted to reciprocate, the additional longitudinal center axis being spaced in a parallel relation from the second longitudinal center axis and being located horizontally between the second side portion and the second longitudinal center axis, the second longitudinal center axis is located closer to the first side portion of the fluid end than the second side portion, and a first horizontal distance between the first side portion and both of the coaxial first and third longitudinal center axes is greater than a second horizontal distance between the first side portion and the second longitudinal center axis;

a first valve located in the first flowpath, wherein the first valve is actuable between a first closed position and a first open position;

and a second valve that is located in the second flowpath, and that is opposed to the first valve located in the first flowpath, wherein the second valve is actuable between a second closed position and a second open position;

wherein the fluid is adapted to be conveyed into the pump chamber, via the first flowpath, when the first valve is in the first open position and the second valve is in the second closed position; and wherein the fluid is adapted to be conveyed out of the pump chamber, via the second flowpath, when the first valve is in the first closed position and the second valve is in the second open position.

* * * * *